US008314828B2

(12) United States Patent
Bombay et al.

(10) Patent No.: US 8,314,828 B2
(45) Date of Patent: Nov. 20, 2012

(54) PERSONALIZATION OF PHYSICAL MEDIA BY SELECTIVELY REVEALING AND HIDING PRE-PRINTED COLOR PIXELS

(75) Inventors: Bart Bombay, Austin, TX (US); Joseph Leibenguth, Saint-Cloud (FR); Jean-Luc Lesur, Bras (FR)

(73) Assignee: Gemalto SA, Meudon (FR)

( * ) Notice: Subject to any disclaimer, the term of this patent is extended or adjusted under 35 U.S.C. 154(b) by 445 days.

(21) Appl. No.: 12/581,151

(22) Filed: Oct. 18, 2009

(65) Prior Publication Data

US 2011/0090298 A1 Apr. 21, 2011

(51) Int. Cl.
*B41J 2/435* (2006.01)
*B41J 2/47* (2006.01)

(52) U.S. Cl. ..... 347/262; 347/225

(58) Field of Classification Search ..... 347/224, 347/225, 262, 264
See application file for complete search history.

(56) References Cited

U.S. PATENT DOCUMENTS

| | | | | |
|---|---|---|---|---|
| 5,543,381 | A | 8/1996 | Kishimoto et al. | |
| 7,368,217 | B2 * | 5/2008 | Lutz et al. | 430/200 |
| 2006/0141391 | A1 | 6/2006 | Klein et al. | |
| 2009/0128615 | A1 | 5/2009 | Miller | |

FOREIGN PATENT DOCUMENTS

| | | | |
|---|---|---|---|
| DE | 4339216 | A1 | 4/1994 |
| EP | 0739677 | A1 | 10/1996 |
| EP | 0776766 | B1 | 6/1997 |
| EP | 0908901 | A | 4/1999 |
| EP | 1129859 | A | 9/2001 |
| EP | 1918123 | A1 | 5/2008 |
| WO | WO03056500 | A | 7/2003 |
| WO | WO2006025016 | A | 3/2006 |
| WO | WO2008031170 | A | 3/2008 |

OTHER PUBLICATIONS

PCT/EP2010/055912, International Search Report, Feb. 15, 2011, European Patent Office, P.B. 5818 Patentlaan 2 NL—2280 HV Rijswijk.
PCT/EP2010/055912, Written Opinion of the International Searching Authority, Feb. 15, 2011, European Patent Office, P.B. 5818 Patentlaan 2 NL—2280 HV Rijswijk.
PCT/EP2010/064447 International Search Report, Jan. 17, 2011, European Patent Office, P.B. 5818 Patenlaan 2 NL—2280 HV Rijswijk.
PCT/EP20101064447 Written Opinion of the International Searching Authority, Jan. 17, 2011, European Patent Office, P.B. 5818 Patenlaan 2 NL—2280 HV Rijswijk.

* cited by examiner

*Primary Examiner* — Huan Tran
(74) *Attorney, Agent, or Firm* — The Jansson Firm; Pehr B. Jansson

(57) ABSTRACT

Personalization of identity card by producing a color image thereon by selectively exposing photon-sensitive layers on the card to change between transparent and opaque thereby selectively revealing opaque colors from the photon-sensitive layer or from a printed substrate. Other systems and methods are disclosed.

34 Claims, 14 Drawing Sheets

PERSONALIZATION OF PHYSICAL MEDIA BY SELECTIVELY REVEALING AND HIDING PRE-PRINTED COLOR PIXELS

FIELD

The present invention relates generally to personalization of secure documents, and more particularly to personalization by producing an image on a document by selectively revealing colored, black, and white pixels by exposing one or more layers of photon-sensitive materials to photons.

BACKGROUND

Many forms of physical media require both mass-production and end-user personalization. For example, identity cards may need to be produced for very large population pools, yet every individual card has to uniquely identify the person carrying the card. The high-volume manufacturing phase may be performed on relatively expensive equipment because the equipment cost may be amortized over very large production runs. On the other hand, the end-user personalization may be preferably carried out at customer locations in relatively low volumes, thus, requiring much lower equipment costs.

For many identity cards, security of all information on the card, whether digitally recorded or physical features of the card, is of paramount importance. The security is sometimes tied to some features that reveal whether the media has physically been tampered with. One mechanism for thwarting attempts to tamper with identity cards is lamination. By securing the physical media in a lamination layer that may not delaminated without destroying the physical pristineness of the media goes very far to protect the security integrity of media.

One very important mechanism for tying an individual to an identity object is the placement of a person's photograph on the identity object. Driver's licenses, passports, identity cards, employee badges, etc., all usually bear the image of the individual to whom the object is connected.

Laser engraving provides one prior art technique for personalizing an identity card post-issuance with a photograph. FIG. 1 is a perspective-exploded view of the various layers that make up such a prior art identity card 50. The identity card 50 may include a laser-engravable transparent polycarbonate layer 57. By selectively exposing an image area on the card with a laser, specific locations in the polycarbonate layer 57 may be rendered black, thereby producing a gray-scale image.

Traditionally polycarbonate (PC) ID products have been personalized using laser-engraving technology. This is based on a laser beam heating carbon particles inside specific polycarbonate layers to the extent that the polycarbonate around the particle turns black. While the particles could be chosen to be something else than carbon, it is the intrinsic property of polycarbonate that creates the desired contrast and number of gray levels to produce, for example, a photograph. The gray tone is controlled by the laser power and speed of scanning across the document. This technology is standard on the ID market. However, a limitation of this technique is that color images may not be produced in that manner.

In certain markets and applications it is desirable to have identity cards with color images.

Traditionally color photographs have been placed in identity cards using Dye Diffusion Thermal Transfer (D2T2) technology, which has been available for PVC and PET products. Recently the development in the D2T2 technology has made it possible to color personalize also polycarbonate cards. This technology requires a smooth printed surface and the printed image must be shielded with an overlay film, which can also be holographic type. Gemalto S/A of Meudon, France has developed a desk-top D2T2 solution which has been available on the market since the autumn 2007.

A drawback to surface printed color personalization is that it is not as secure as the laser engraved photos and data that are situated inside the polycarbonate layer structure as illustrated in FIG. 1.

In another prior art alternative, a color image may be produced using digital printing before the product is collated. This allows for high quality images placed on identity cards. Yet this technology has many drawbacks: the personalization and card body manufacturing must happen in the same premises, which furthermore typically have to be in the country of document issuance because governmental authorities dislike sending civil register data across borders, the color printed photographs prevent the PC layers from fusing to each other, and if any of the cards on a sheet is maculated in further production steps, the personalized card must be reproduced from the beginning of the process leading to a highly complicated manufacturing process.

U.S. Pat. No. 7,368,217 to Lutz et al., Multilayer Image, Particularly a Multicolor Image, May 6, 2008 describes a technique in which color pigments are printed on collated sheets and each color may be bleached to a desired tone using a color sensitive laser.

From the foregoing it will be apparent that there is a need for an improved method to provide a mechanism for placing images on identity cards and the like using a mechanism that produces secure tamper proof color images during a personalization phase using inexpensive customer-premises equipment.

BRIEF DESCRIPTION OF THE DRAWINGS

FIG. 6(*b*) further refines the alternative embodiment in an alternative sub-embodiment to the alternative embodiment of FIG. 6(*a*).

FIG. 8(*b*) is an illustration of one pixel of the portion shown in magnification in FIG. 8(*a*).

FIG. 14 is a flow-chart of the identity card life cycle modified to personalize identity cards of FIGS. 2 and 3 in the manner of processes of FIGS. 9 through 11 using equipment of FIG. 12 or 13 or the like.

Figure 1:
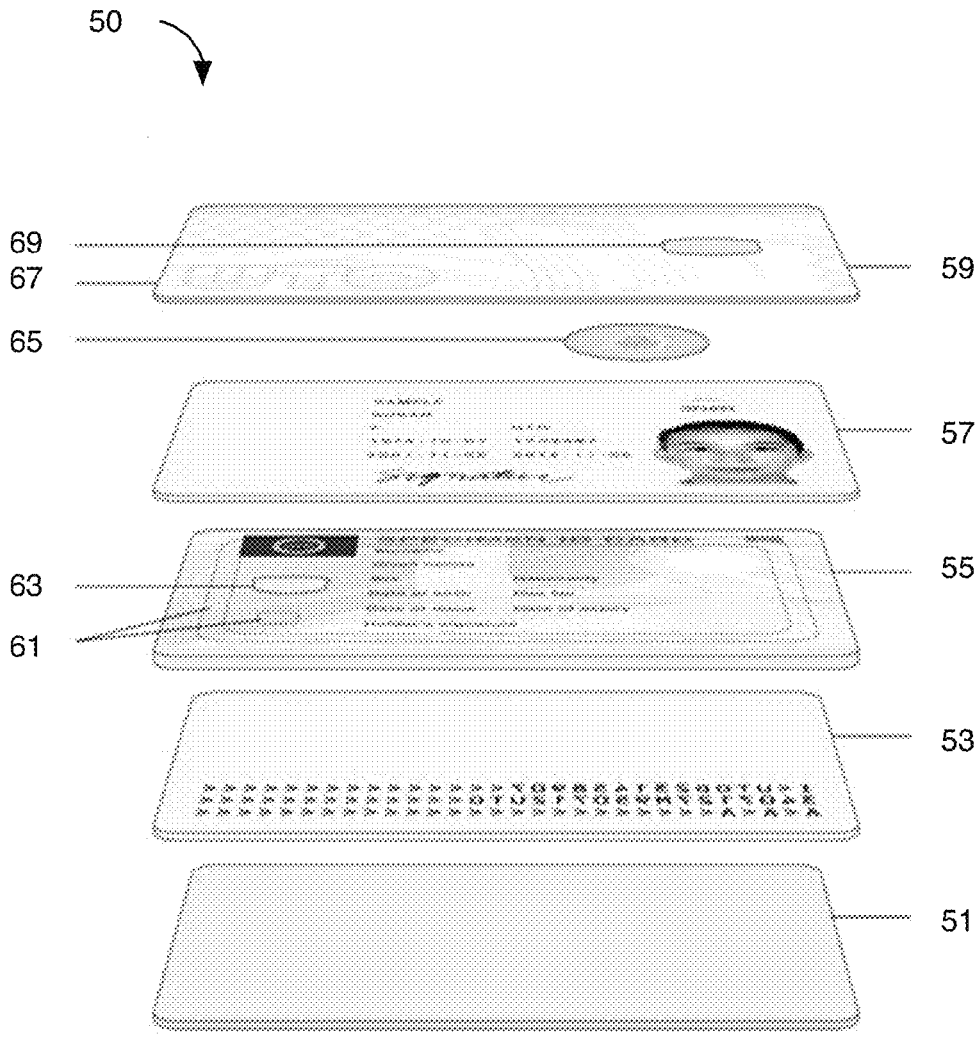
Fig. 1 (Prior Art)
FIG. 1 is an exploded perspective view of a prior art identity card that allows some level of personalization of the physical appearance of the card post-issuance.

In the appended figures, similar components and/or features may have the same reference label. Further, various components of the same type may be distinguished by following the reference label by a dash and a second label that distinguishes among the similar components or by appending the reference label with a letter or a prime (') or double-prime ("). If only the first reference label is used in the specification, the description is applicable to any one of the similar components having the same first reference label irrespective of the second reference label appended letter, or prime.

DETAILED DESCRIPTION OF THE INVENTION

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

An embodiment of the invention, provides a mechanism by which physical media such as identification cards, bank cards, smart cards, passports, value papers, etc. may be personalized in a post-manufacturing environment. This technology may be used to place images onto such articles inside a lamination layer after the lamination layer has been applied. In an alternative embodiment, a protective lamination layer is added to the identity card after personalization. Thus, the articles, for example, smart cards, may be manufactured in a mass produced fashion in a factory setting and personalized on relatively inexpensive and simple equipment at a customer location. The technology provides a mechanism for thus personalizing articles, such as smart cards, bank cards, identity cards, with an image that is tamper resistant. Herein, the purpose of providing a clear narrative, the term identity card is used to refer to the entire class of physical media to which the herein-described techniques may be applied even if some such physical media are not "cards" in a strict sense. Without limiting the application of the term identity card it is intended to include all such alternatives including but not limited to smart cards (both contact and contactless smart cards), driver's licenses, passports, government issued identity cards, bankcards, employee identification cards, security documents, personal value papers such as registrations, proofs of ownership, etc.

In a typical smart card lifecycle, a card is initially manufactured in a factory setting. The manufacturing step includes placing an integrated circuit module and connectors onto a plastic substrate, typically in the shape of a credit card. The integrated circuit module may include systems programs and certain standard applications. The card may also be imprinted with some graphics, e.g., the customer's logo.

Next the card is delivered to the customer.

The customer, for example, a government agency, a corporation, or a financial institution, who wishes to issue secure identification cards to its customers, the end-users of the cards, next personalizes the cards. Personalization, "perso" in industry parlance, includes the customer placing its application programs onto the card, and end-user specific information on the card. Perso may also include personalizing the physical appearance of the card for each end-user, e.g., by printing a name or photograph on the card.

Once the card has been personalized, the card is issued to the end-user, e.g., an employee or a client of the customer, step 40.

Other identity cards have similar life cycles.

FIG. 1 is an exploded perspective view of a prior art identity card 50 that allows some level of personalization of the physical appearance of the card post-issuance, e.g., by the customer. Such a card 50 may, for example, have the following layers:

a transparent polycarbonate (PC) layer 59
a laser-engravable transparent PC layer 57
an opaque white PC core 55
a laser-engravable transparent PC layer 53
a transparent PC layer 51

As anti-counterfeiting measures, the top PC layer 59 may include some embossing 67 and a changeable laser image/multi laser image (CLI/MLI) 69. To further enhance security the card 50 may include features such as a DOVID 65, i.e., a Diffractive Optical Variable Image Device such as a hologram, kinegram or other secure image, and a Sealy's Window 63 (a security feature, provided by Gemalto S. A., Meudon, France, in which a clear window that turns opaque upon tampering is provided in the card). The card 50 may also contain a contact less chip and antenna system 61.

During personalization the laser-engravable transparent layers 57 and 53 may be provided with a gray-scale image and identifying text.

Figure 2:
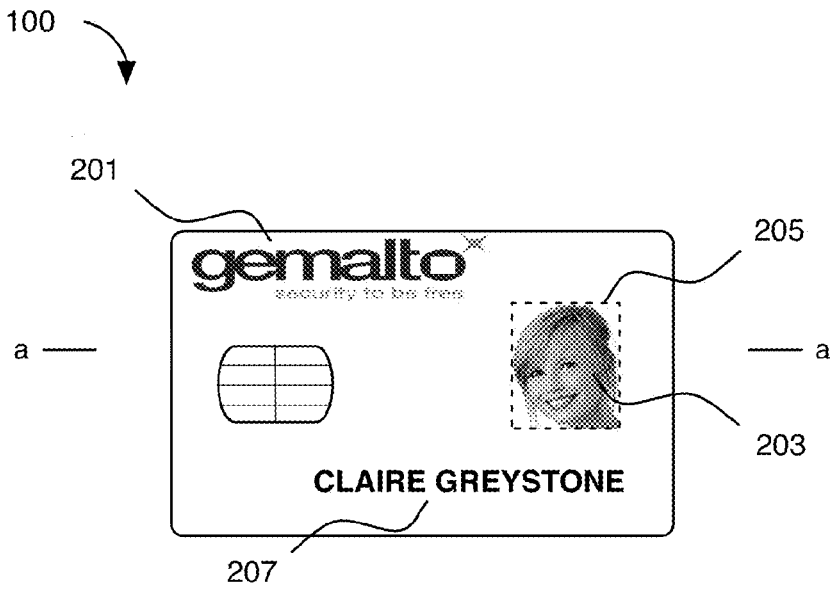
FIG. 2 is a top-view of an identity card according to one embodiment of the technology described herein.

FIG. 2 is a top-view of an identity card 100 according to one embodiment of the technology described herein. Briefly, the identity card 100 is provided with an image area 205 that is constructed from several layers of material located between a substrate (e.g., a PC core) and a lamination layer. The bottom layer of these image-area layers is a print-pixel grid (see FIGS. 3 through 8) which consists of a plurality of specifically arranged areas having distinct colors. The print-pixel grid is covered by a transparent layer and an opaque layer of photon-sensitive materials. The transparent layer may be selectively altered to some level of opaque black and the opaque layer may be selectively altered to transparent. Thus, by selective manipulation of the photon-sensitive layers, any given location of the image area 205 may be made to display a specific color from the print-pixel grid, black (or a darkened shade of the underlying grid sub-sub-pixel), or white. By selectively manipulating the photon-sensitive layers of the addressable locations (as is discussed hereinbelow, the addressable locations are referred to herein as sub-sub-pixels) of the image area, an image may be produced. The structure of the print-pixel grid and the photon-sensitive layers, and the process of manipulating these layers to produce an image are discussed in greater detail herein below.

The identity card 100 may have been printed with a company-logo or other graphic. Through a unique process and manufacture described in greater detail herein below, the identity card 100 contains a color image 203, for example, a photograph of the intended end-user, printed in an image area 205. The identity card 100 may further have been personalized with a printed name 207. The printed name 207 may be applied to the card using the same techniques as described-herein for applying an image 203 to the identity card 100.

Figure 3A:
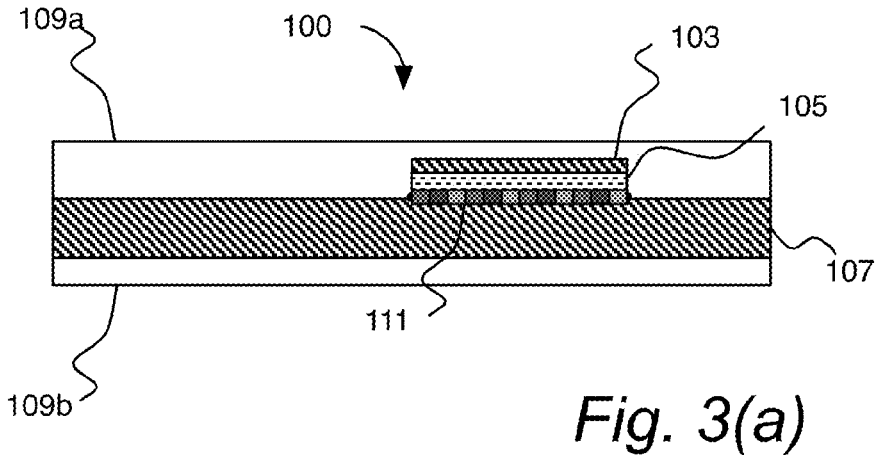
FIGS. 3(*a*) through 3(*c*) are cross-section views of three alternative embodiments of the identity card illustrated in FIG. 2.
Figure 3B:
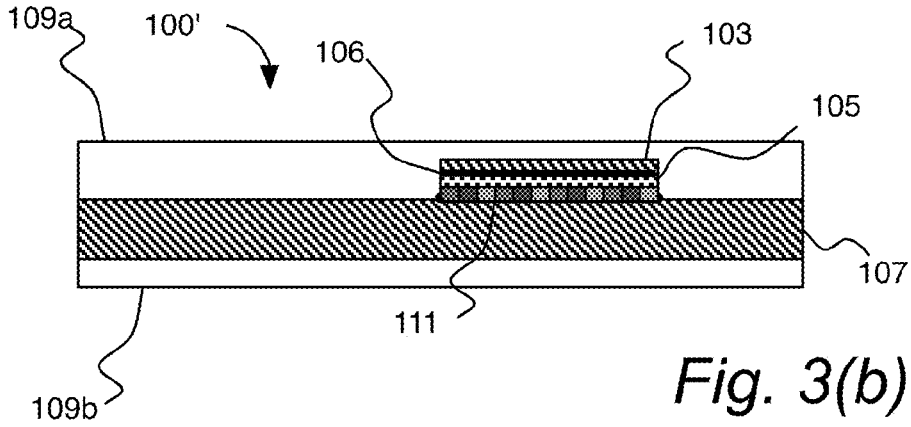
Figure 3C:
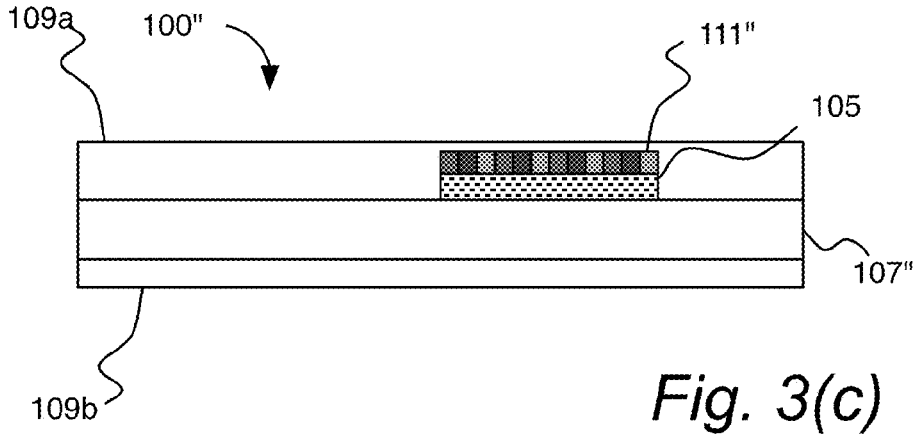

FIG. 3(*a*) is a cross-section of the identity card 100 of FIG. 2 taken along the line a-a. The identity card 100 consists of a substrate 107. The substrate 107 may be constructed from a plastic material, for example, selected from polycarbonate polyvinyl chloride (PVC), acrylonitrile butadiene styrene (ABS), PVC in combination with ABS, polyethylene terephthalate (PET), PETG, and polycarbonate (PC). As with the prior art identity card 50 of FIG. 1, the identity card 100 may include additional layers, e.g., laser-engravable PC layers 53 and 59 and transparent PC layers 51 and 59.

A print-pixel grid 111 is located on one surface of the substrate 107 (substrate 107 is meant herein to refer to any of the internal layers of the card 100, e.g., similar to the opaque PC layer 55, either transparent PC layer 53 or 57, or internal layers constructed from alternative materials) in an area of the substrate corresponding to the image area 205. The print-pixel grid 111, which is described in greater detail herein below in conjunction with, for example, FIGS. 4 through 8, may be printed onto the substrate using conventional offset printing or using any other technique for accurately laying down a colored pattern onto the substrate.

The print-pixel grid 111 is covered by a transparent photon-sensitive layer 105. The transparent photon-sensitive layer 105 is manufactured from a material that converts from being transparent to some level of opaqueness upon being exposed to photons of particular wavelength and intensity. Suitable materials include carbon-doped polycarbonate. Traditionally polycarbonate (PC) ID products have been personalized using laser-engraving technology. This personalization is based on a laser beam heating carbon particles inside specific polycarbonate layers to the extent that the polycarbonate around the particle turns black. While the particles could be materials other than carbon, it is the intrinsic property of polycarbonate that creates the desired contrast and number of gray levels to allow creation of a photographic image. The gray tone is controlled by the laser power and speed of scanning across the image area 205. Thus, a carbon-doped transparent PC layer may be selectively altered into an opaque layer along the darkness scale by exposing select location with a Nd-YAG laser or Fiber Laser. An Nd-YAG laser emits light at a wavelength of 1064 nanometers in the infrared light spectrum. Other Nd-YAG laser wavelengths available include 940, 1120, 1320, and 1440 nanometers. These wavelengths are all suitable for turning a transparent PC layer opaque black or partially opaque with an intensity in the range of 10 to 50 watts. In a typical application, the Nd-YAG laser is scanned (in the manner discussed in greater detail below) over the image area for a duration of approximately 4 seconds exposing specific locations as required. Fiber lasers that are suitable for turning the transparent PC layer opaque or partially opaque operate in wavelengths in the range of 600 to 2100 nanometers. While some specific lasers and wavelengths are discussed herein above, any alternative photon source, e.g., a UV laser, that converts a location on a transparent PC layer opaque may be employed in lieu thereof.

The transparent photon-sensitive layer 105 is covered with an opaque layer 103 that may be altered into a transparent layer by exposure to photons in a particular wavelength and intensity. Suitable materials for the opaque-to-transparent photon-sensitive layer include a white bleachable ink that may be laid down on top of the transparent-to-opaque layer 105 through thermal transfer or die sublimation, for example. Examples, include SICURA CARD 110 N WA (71-010159-3-1180) (ANCIEN CODE 033250) from Siegwerk Druckfarben A G, Sieburg, Germany, Dye Diffusion Thermal Transfer (D2T2) inks available from Datacard Group of Minnetonka, Minn., USA or Dai Nippon Printing Co., Tokyo, Japan. Such materials may be altered selectively by exposing particular locations by a UV laser at a wavelength of, for example, 355 nanometers or 532 nanometers with an intensity in the range of 10 to 50 watts for a few milliseconds per addressable location (sub-sub-pixel). To alter the sub-sub-pixels in the opaque-to-transparent layer 103 the laser is continuously scanned over the image area exposing those sub-sub-pixels that are to be altered from opaque white to transparent in the opaque-to-transparent layer 103 by ink bleaching or evaporation. In an alternative embodiment, the same UV laser wavelength that removes the ink of the opaque-to-transparent layer 103 may also be used to alter the carbon-doped transparent-to-opaque layer 105 below the removed sub-sub-pixels of the opaque-to-transparent layer 103 when there is residual power available from the UV laser.

Figure 4:
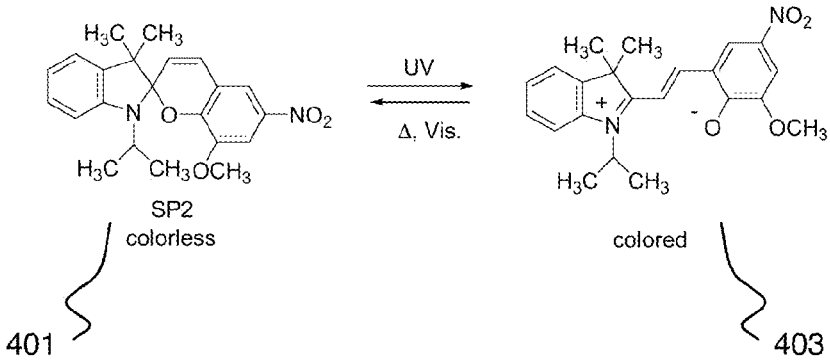
FIG. 4 illustrates the chemical reaction relied upon in one embodiment for the purpose of altering specific locations of one layer of the card depicted in FIGS. 2 and 3 from transparent to opaque.

In an alternative embodiment the opaque-to-transparent layer 103 is a photon-sensitive layer that is amenable to a dry photographic process that requires no chemical picture treatment. One example is spiropyran photochrom with titanium oxide (similar to the material used to produce with PVC). This process is based on the photochemical behavior of colored complexes between spiropyrans and metal ions. FIG. 4 illustrates the chemical reaction. When spiropyran SP2 401, which is a closed structure, is exposed to UV light, it transforms into an open structure 403 that is colored. A suitable alternative to SP2 401 is spiropyran indolinic (3',3'-diméthyl-1-isopropyl-8-méthoxy-6-nitrospiro[2H-1-benzopyrane-2, 2-indoline]).

In an alternative embodiment, illustrated in FIG. 3(*b*), the opaque-to-transparent layer 103 is augmented with a doped organic semiconductor layer 106. The doped organic semiconductor layer 106 is useful as an amplifier to improve the speed by which the opaque-to-transparent layer 103 transforms from opaque to transparent. Example materials for the doped organic semiconductor layer 106 include polyvinyl carbazol and polythiophenes. A polyvinyl carabazol layer 106 may be laid down by evaporation of 2.5 grams of polyvinyl carabazol in 50 cubic-centimeters of dichloromethane. The semiconductor layer 106 is preferably doped to match the energy levels required for a photochromic effect in the opaque-to-transparent layer 103.

The photochromic effect of spiropyran-based opaque-to-transparent layer 103 may be achieved by exposure to visible or ultraviolet light. The preferred intensity is in the range of 50 to 200 watts at a distance of 30 to 300 millimeters for a duration of 10 to 300 seconds.

The principle of preparation of emulsions for a dry color printing process has been patented by Prof. Robillard (US Pat. Appl. 2004259975). The results of feasibility investigation is described in a J. Robillard et al, *Optical Materials,* 2003, vol. 24, pp 491-495. The process involves photographic emulsions that require exclusively light of the UV or visible range for producing and fixing images. The emulsions include colored photochromic dyes and a system for amplification and exhibit photosensitivity comparable to those of the known silver-containing conventional materials. In general, this process is applicable for any kind of supports (paper, tissues, polymeric films).

Finally, the identity card 100 is covered with an upper lamination layer 109*a* and a lower lamination layer 109*b*. The lamination layers 109 provide security in that they protect the image 203 produced in the image area 205 from physical manipulation. The upper lamination layer 109*a* should be transparent to the photon wavelengths used for altering the transparent-to-opaque layer 105 and the opaque-to-transparent layer 103. Furthermore, the lamination temperature should be low enough as to not alter the transparent-to-opaque layer 105 or opaque-to-transparent layer 103, for example, in the range of 125 to 180 degrees Celsius. Suitable materials include PVC, PVC-ABS, PET, PETG, and PC.

FIG. 3(*c*) is a cross-section view of yet another alternative embodiment for an identity card 100" that may be personalized with a color image produced on the card during the personalization phase. A photon-sensitive print-pixel grid 111" is located above a carbon-doped PC layer 105 which in turn is located above a white opaque PC layer 107". The print-pixel grid 111" in this case consists of multiple sub-sub-pixels that may be selectively removed by exposure to photons of appropriate wavelength and intensity. The image area 205 may be customized with a color image 203 by selectively removing colored sub-sub-pixels from the photon-sensitive pixel-grid 111" and by subjecting the carbon-doped PC layer 105 selectively to photon-energy that alters select portions thereof from transparent to black.

While it is desirable to prepare the entire card during the manufacturing phase of the card life-cycle, in some embodiments applying the technology described herein that is not practical because the upper lamination layer 109*a* could prevent evaporation of dyes from the opaque-to-transparent layer 103 or 111". Therefore, if the alteration of one of the photon-sensitive layers requires evaporation or some other form of material removal in the process of transforming from one state to another, e.g., from opaque to transparent, the upper lamination layer 109*a* may be added during the personalization phase, for example, after the image area 205 has been personalized as described herein. Such lamination may be performed using DNP CL-500D lamination media from Dai Nippon Printing Co., Tokyo, Japan or other suitable lamination technology.

Figure 5:
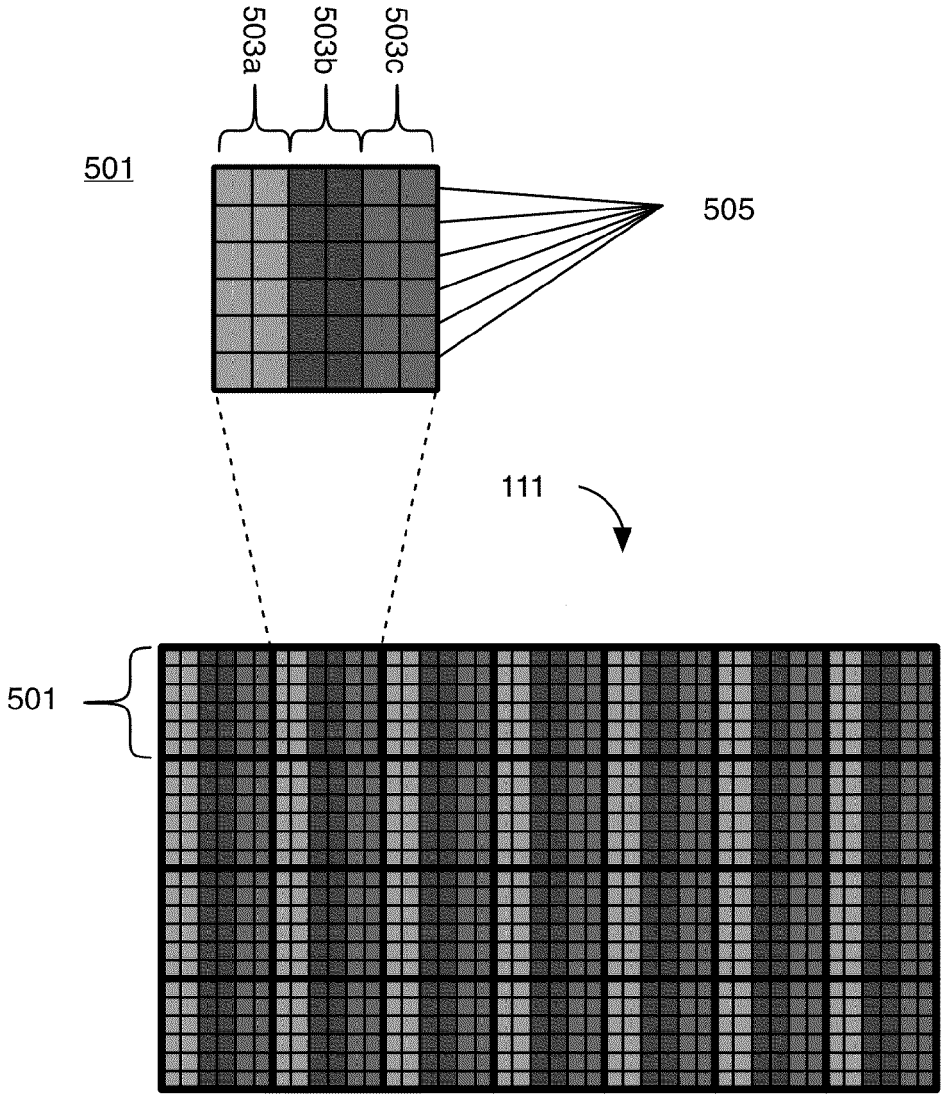
FIG. 5 is an illustration of one embodiment of a print-pixel grid.

Turning now to the structure of the print-pixel grid 111, for which a small portion is illustrated in FIG. 5. The print-pixel grid 111 is composed of an array of print-pixels 501. A print-pixel 501 corresponds to a pixel in a bitmap of an image, e.g., one pixel in a file in the .bmp format. In the small portion of a print-pixel grid 111 illustrated in FIG. 5, contains a 4×7 grid of print-pixels 501. In a real-life print-pixel grid 111 a grid having many more print-pixels in each dimension would be necessary for producing a meaningful image. Each print-pixel 501 contains 3 rectangular sub-pixels 503*a*, 503*b*, and 503*c*, each corresponding to a unique color, e.g., green, blue, and red as illustrated in the example. For the purpose of being able to produce various color combinations, each sub-pixel 503 is subdivided into a plurality of sub-sub-pixels 505. In the example of FIG. 5, each sub-pixel 503 is composed of a 2×6 grid of sub-sub-pixels 505.

The term print-pixel is used herein to the equivalent of a pixel in a digital image that is printed in the print-pixel grid and having a plurality of sub-pixels that each form a portion of the print-pixel, and the corresponding areas in the photon-sensitive layers that cover the image area 205. A sub-pixel is a single-color area of the print-pixel. A sub-sub-pixel is a single addressable location in a sub-pixel. Thus, a sub-pixel is composed of one or more sub-sub-pixels. A sub-sub-pixel may take its exposed color from either the print-pixel grid or any of the photon-sensitive layers.

Figure 6A:
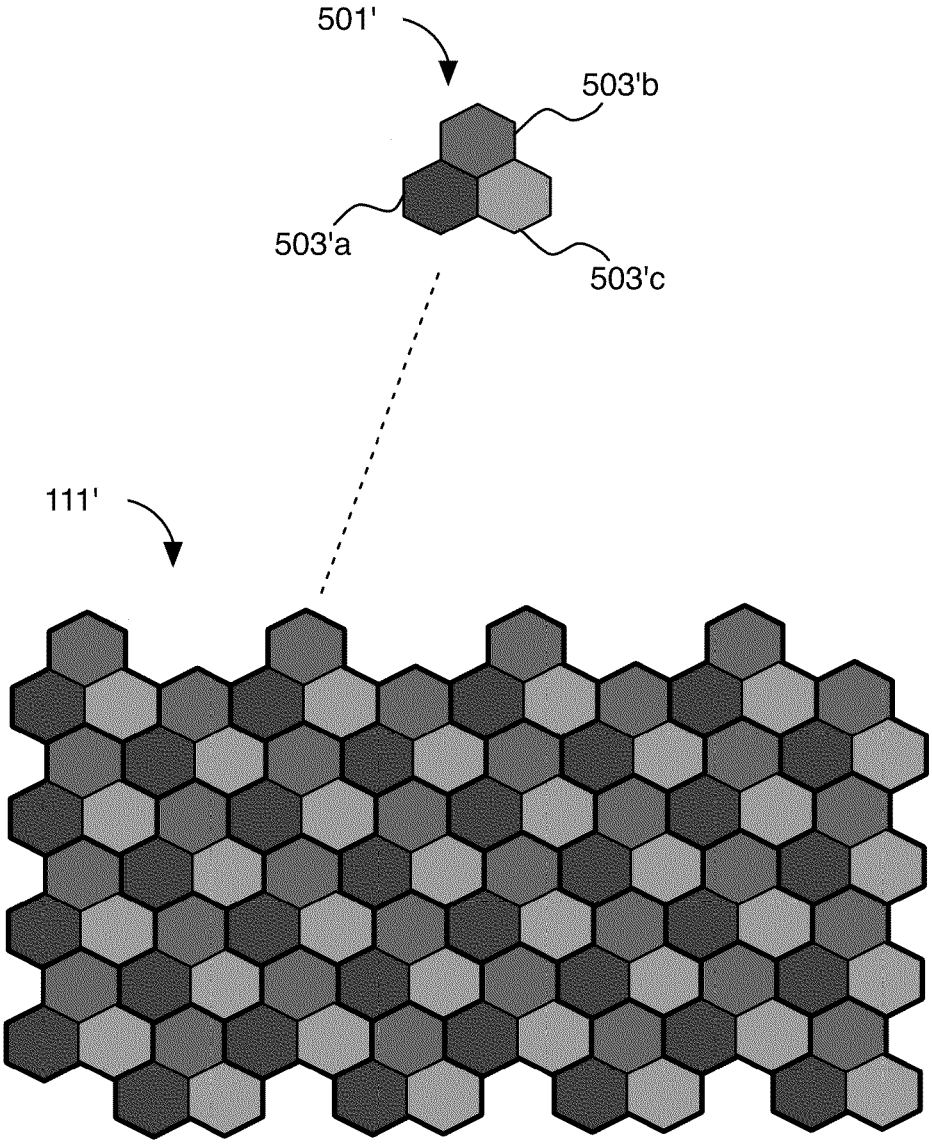
FIG. 6(*a*) is an illustration of an alternative embodiment of a print-pixel grid.
Figure 6B:
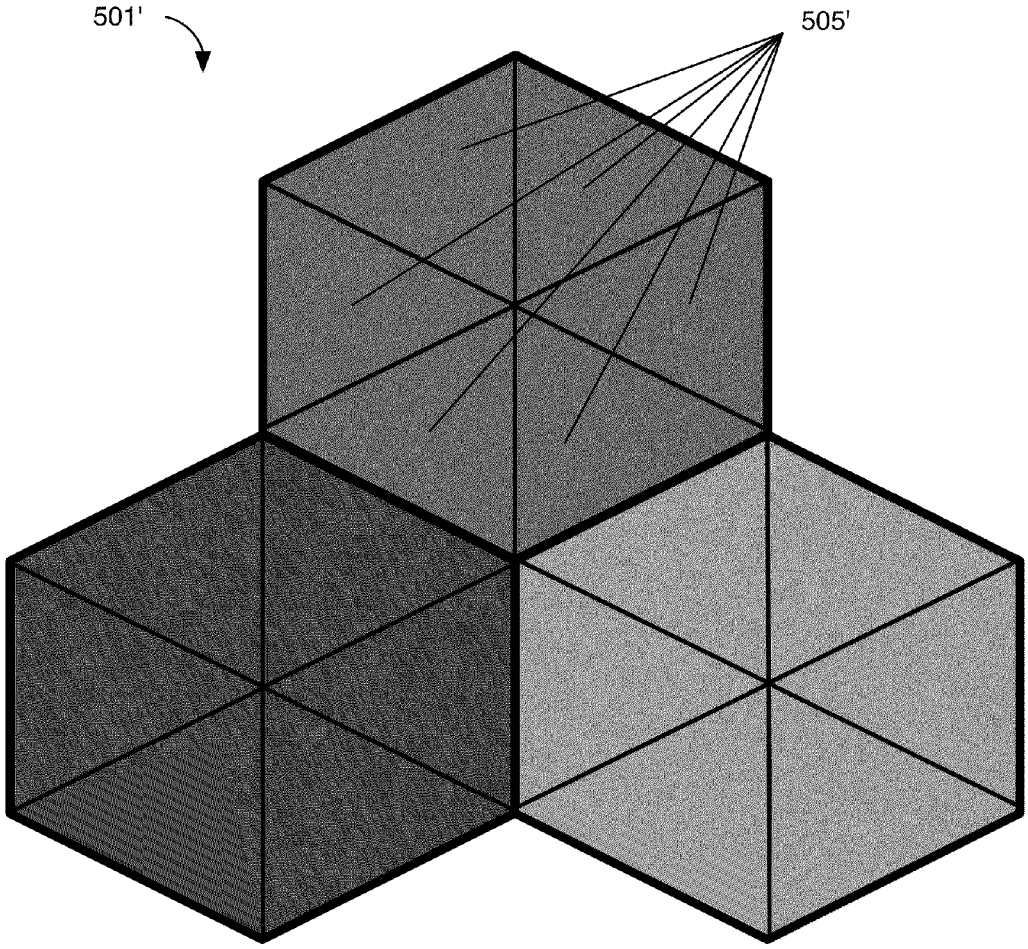

FIG. 6(*a*) is an illustration of an alternative print-pixel grid 111' composed of print-pixels 501' that are composed of hexagonal sub-pixels 503'. As is illustrated in FIG. 6(*b*), in an alternative sub-embodiment which refines the embodiment of FIG. 6(*a*), each hexagonal sub-pixel 503' is composed of six triangular sub-sub-pixels 505' that when connected form the hexagonal sub-pixel 503'. As must be appreciated, while FIGS. 5 and 6 illustrate two different print-pixel structures, there are many more possible structures. All such alternatives must be considered equivalents to the print-pixel structures illustrated here as examples.

Figure 7:
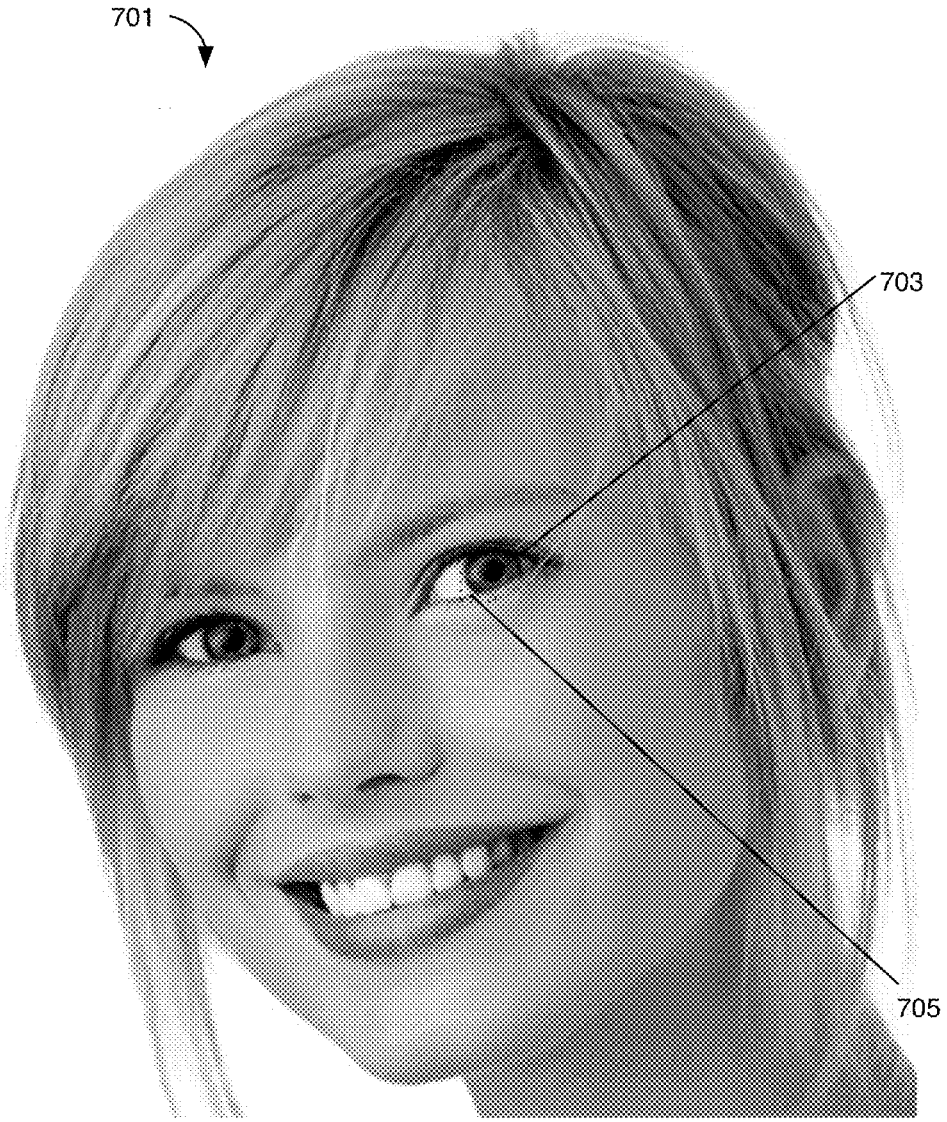
FIG. 7 is an example photographic image presented for illustrative purposes.
Figure 8A:
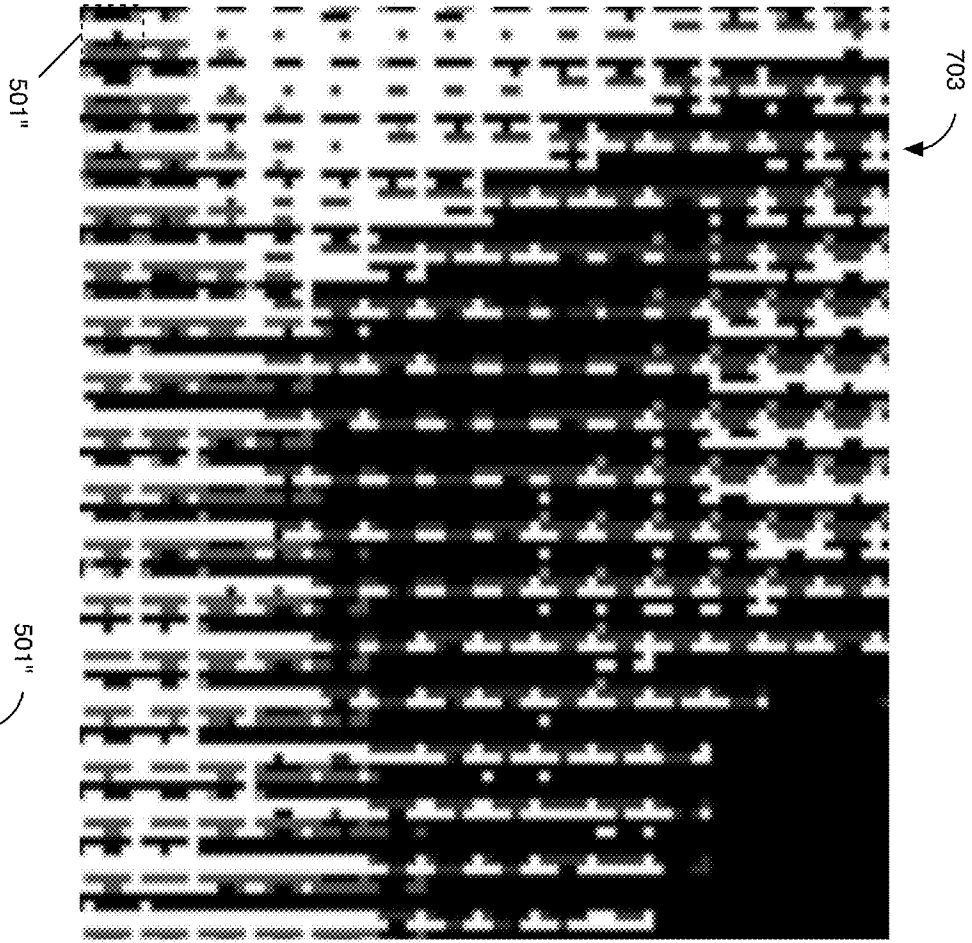
FIG. 8(*a*) is an illustration of a magnification of a portion of the photographic image of FIG. 7 and an even greater magnification of one printpixel used to render one pixel of the image of FIG. 7.
Figure 8B:
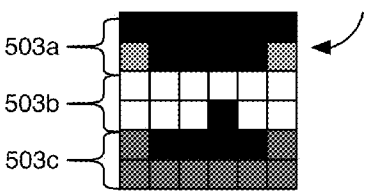

FIG. 7 is a color photograph 701 of a model and is presented here as an illustrative example. Consider the lower-left quarter 703 of the model's right eye (right and left being from the perspective of the viewer). This portion 703 of the model's eye is shown in greater magnification in FIG. 8(*a*). The image 701 is created by selectively turning on specific colors from the transparent-to-opaque layer 105, the opaque-to-transparent layer 103, and from the print-pixel grid 111 for each sub-sub-pixel 505 that make up the print-pixels 501 forming the image. Consider the lower left print-pixel 501" of the eye portion 703 which is illustrated in greater detail in FIG. 8(*b*). The lower left print-pixel 501" lies on the model's lower eyelid and has pinkish red coloration. To achieve that coloration, a large portion of the red sub-pixel 503*c*" is revealed by 8 of 12 red sub-sub-pixels 505 of the underlying print-pixel grid. The blue sub-sub-pixels are entirely obscured by the opaque white layer and most of the green sub-sub-pixels are obscured by the black layer, thereby giving a neutral brightness and primarily red coloration to the print-pixel 501".

Figure 9A:
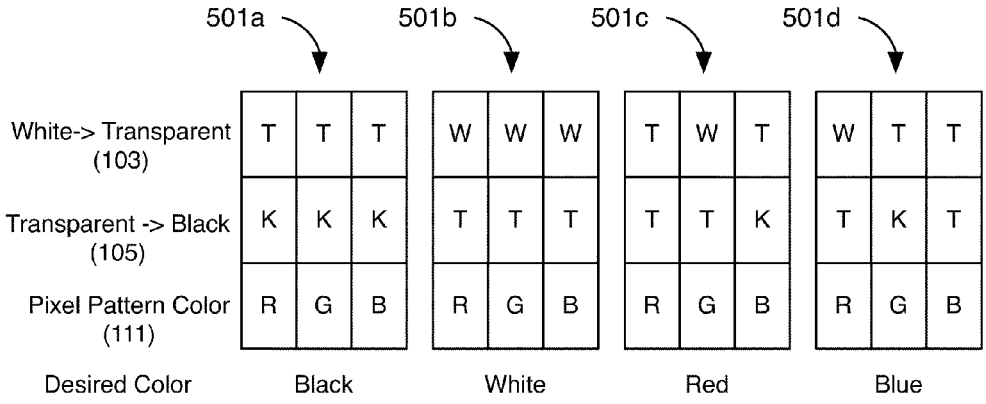
FIGS. 9(*a*) and (*b*) are illustrations showing how the various layers set forth in FIG. 3 may be manipulated to produce particular colors for one print-pixel.
Figure 9B:
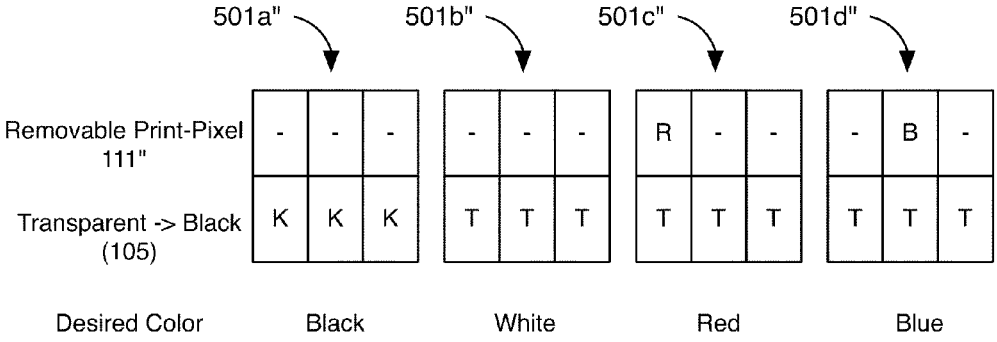

FIG. 9(*a*) illustrates the manipulation of the opaque-to-transparent layer 103 and the transparent-to-opaque layer 105 to produce desired colors for a print-pixel 501 by displaying the cross-section of each of a black print-pixel 501*a*, a white print-pixel 501*b*, a red print-pixel 501*c*, and a blue print-pixel 501*d*. For each print-pixel 501*a* through 501*d* illustrated in FIG. 9(*a*), each column represents one sub-pixel 503. Sub-sub-pixels 505 are not illustrated in FIG. 9. To produce a solid black print-pixel 501*a*, the opaque-to-transparent layer 103 is made transparent (T) by exposing the print-pixel 501*a* to the state-changing light necessary to alter the opaque-to-transparent layer 103 of the print-pixel from opaque white (W) to transparent (T). To produce a solid white print-pixel 501*b* the print-pixel 501*b* is not illuminated at all because the default state for the opaque-to-transparent layer 103 is white. For a solid white print-pixel 501*b*, the transparent-to-opaque layer 105 may have any value as it is occluded by the opaque white layer 103. However, typically it would be left transparent (T). To produce a red print-pixel 501*c*, both the opaque-to-transparent layer 103 and the transparent-to-opaque layer 105 are configured in their transparent state (T) for the area over the red (R) sub-pixel. That effect is produced by exposing the opaque-to-transparent layer 103 to the state-altering photons for the opaque-to-transparent layer 103 while leaving the transparent-to-opaque layer 105 in its native state. The opaque-to-transparent layer 103 for either the green or blue sub-pixel may be altered to transparent (T) and the corresponding location on the transparent-to-opaque layer 105 may be altered to black (K) to reveal a black sub-pixel. By combining black and white sub-pixels or sub-sub-pixels for the non-colored sub-pixels or sub-sub-pixels may be used to adjust the brightness of the pixel 501. The blue pixel 501*d* is produced similarly to the red pixel 501*c*.

FIG. 9(*b*) illustrates the manipulation of the photon-sensitive print-pixel layer 111" and the carbon-doped transparent layer of the alternative identity card 100" illustrated in FIG. 3(*c*). To create a black pixel 501*a*" the removable ink of all the sub-pixels 503 of the location of the photon-sensitive print-pixel layer 111" are removed (–). As with the white opaque-to-transparent layer 103, certain inks may be bleached with UV laser exposure and thus removed. The same ink may be transparent to YAG laser which may be used to transform the transparent-to-opaque layer 105 to all black (K), thus rendering the pixel 501*a*" black. To leave the pixel 501*b*" white, the pigmentation for the print-pixel 111" layer are removed (–). However, the transparent-to-opaque layer 105 is not exposed to a laser and therefore remains transparent (T), thereby leaving the pixel 501*b*" white. For red, the pigmentation of the green and blue sub-pixels is removed (–) through exposure to a UV laser while the transparent-to-opaque layer 105 corresponding to the red (R) sub-pixel, respectively, may be transformed to a shade of gray to provide a darker background. It should be noted that FIG. 9(*b*) only shows a few possible combinations. By altering the adjacent sub-pixels between black and white, as well as the grayscale value of the underlying layer, many different effects may be achieved.

While FIGS. 9(*a*) and 9(*b*) illustrate the manipulation of the photon-sensitive layers on a sub-pixel level, it must be noted that actual print-pixels 501 are composed of many sub-sub-pixels 505 and that many color and brightness variations may be produced by selectively revealing colored, black, and white sub-sub-pixels in suitable combination to produce the desired coloration and brightness for a given print-pixel 501.

Figure 10:
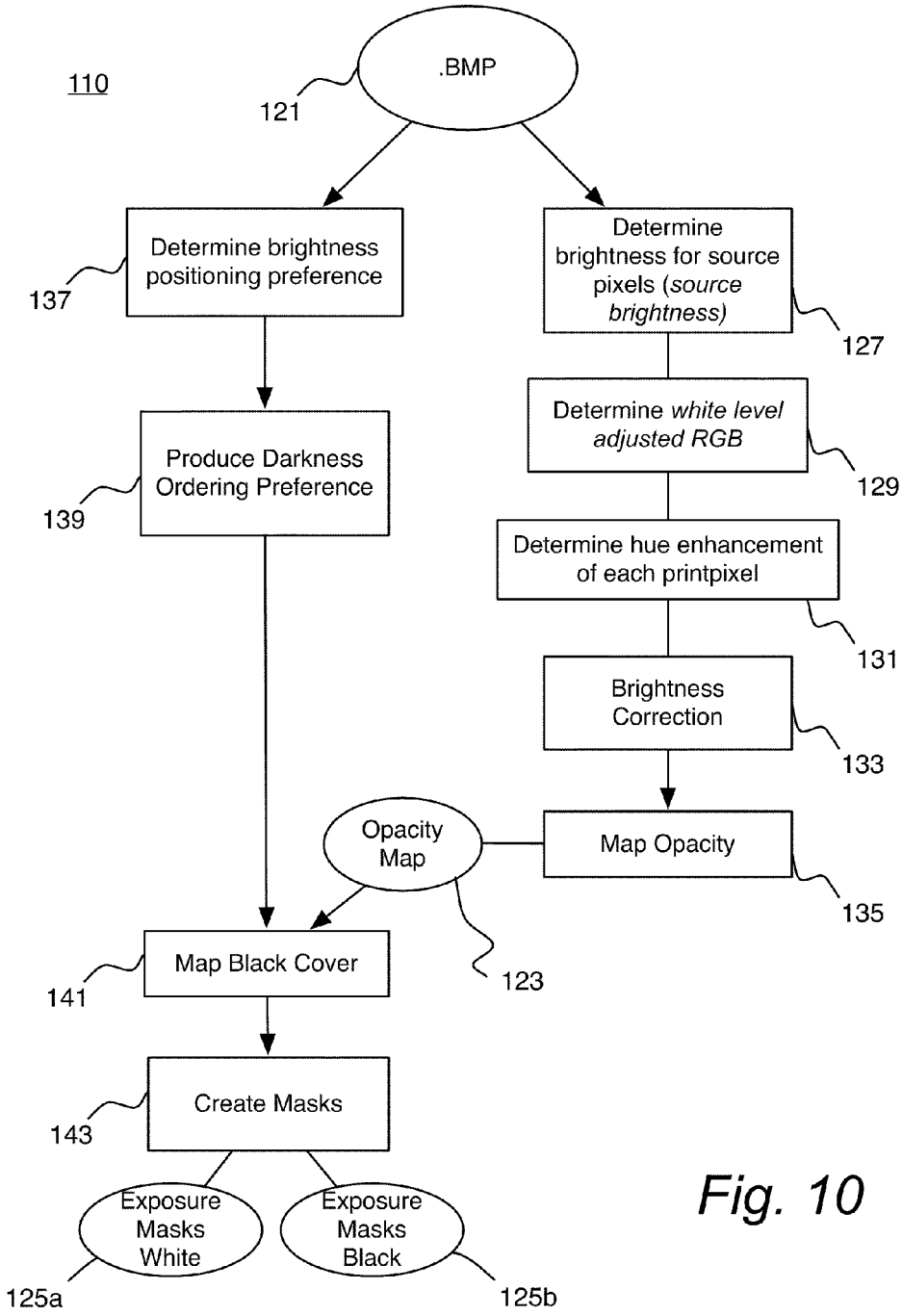
FIG. 10 is a flow chart illustrating the process for producing masks that may be used to control personalization equipment to produce an image on an identity card illustrated in FIGS. 2 and 3 having a printpixel grid and photon-sensitive layers.

Turning now to the computation of masks for the transparent-to-opaque layer 105 and the opaque-to-transparent layer 103. The determination of which sub-sub-pixels 505 are to be left opaque white, are to be turned into opaque black, or are to reveal the underlying color from the print-pixel grid 111 is controlled by a mask for each of the photon-sensitive layers. These masks may, for example, have an on/off value for each sub-sub-pixel in the image area 205 or a value indicate the level of opacity the particular photon-sensitive layer is to provide for each sub-sub-pixel. FIG. 10 is a flow-chart illustrating the steps of one embodiment for computing these masks. The description should not be considered limiting as there are other possible algorithms for producing the masks.

The process 110 accepts as input a digital image 121, for example, in the .bmp format. A .bmp format image file 121 is a bitmap for each pixel in an image to particular RGB (red-green-blue) values. The process 110 converts the image file 121 into an exposure mask white 125*a* and an exposure mask black 125*b*. These exposure masks 125 are provided as input to a controller 355 (FIGS. 12 and 13) for controlling the exposure of sub-sub-pixels of the transparent-to-opaque layer 105 and opaque-to-transparent layer 103. The goal in designing the masks 125 is to produce an image that resembles the image of the digital image file 121.

It is assumed here that there is a one-to-one correspondence between each pixel of the source image 121 to each print-pixel 501 of the print-pixel grid 111. Otherwise, a preprocessing conversion algorithm can be applied. Furthermore, the process 110 is described with respect to square print-pixels 501 with three rectangular sub-pixels 503 for green, blue and red, respectively, as illustrated in FIG. 5. In alternative embodiments, other pixel and sub-pixel shapes and colors are possible. For example, in one alternative, the print-pixel pattern includes either black or white (or both) sub-pixels that may take the place of one of the photon-sensitive layers 103 or 105. In yet another alternative, the print-pixel pattern includes colors such as cyan, magenta, and yellow to allow for greater variability in displayed colors. For such alternatives, the process 110 would be modified to account for such different structures in the print-pixel pattern and the covering photon-sensitive layers.

From one perspective an objective of the process 110 is to determine how much of each color sub-pixel 503 is to be visible for each print-pixel in the resulting image 203. A second objective is the determination of the opacity for the transparent-to-opaque layer 105 because that layer may take on varying degrees of opacity. Third, the process 110 determines the ratio between black and white fully obscuring sub-sub-pixels and the locations for such sub-sub-pixels.

The brightness of each source pixel is determined, step 127, by the following formula:

```
public static float brightness(float red, float
green, float blue)
{
    return (0.30 * red + 0.55 * green + 0.15 * blue);
}
```

where red, green, and blue are numeric component of the source image and have values in the range zero and max (255). The resulting brightness value thus is in the same range (0–max (255)).

Next whitelevel adjusted RGB values are computed, step 129. This calculation begins with the computation of whitelevel:

whitelevel=min(red,green,blue)

Adjusted RGB values are computed by:

AdjustedRED=red−whitelevel

AdjustedGREEN=green−whitelevel

AdjustedBLUE=blue−whitelevel where red, green, and blue are the RGB values in the source image.

Next a hue enhancement is computed and the adjusted RGB values are further adjusted for the hue enhancement, step 131, as follows:

$$maxComponent = \max(AdjustedRED, AdjustedGREEN, AdjustedBLUE)$$

if ($maxComponent <> 0$) then $$hueFactor = \min\left(\frac{(255 - (255 - maxComponent)/2)}{maxComponent}, 3.0\right)$$

$$AdjustedRED = hueFactor * AdjustedRED$$

$$AdjustedGREEN = hueFactor * AdjustedGREEN$$

$$AdjustedBLUE = hueFactor * AdjustedBLUE$$

This calculation produces for each print-pixel 501 the portion size of each red, green, and blue sub-pixel to be fully revealed. The portion size is the converted to conform to the number of sub-sub-pixels available for each color sub-pixel:

numSubSubRED=totalSubSub*AdjustedRED÷255 numSubSubGREEN=totalSubSub*AdjustedGREEN÷255 numSubSubBLUE=totalSubSub*AdjustedBLUE÷255 where totalSubSub is the number of sub-sub-pixels 505 per sub-pixel 503 and numSubSubRED, numSubSubGREEN, and numSubSubBLUE each are floating point values corresponding to the number of sub-sub-pixels that would be necessary to cover the sub-pixel 503 with the corresponding portion of red, green, and blue, respectively.

Next, each print-pixel is brightness adjusted, step 133, as follows:

$$totalRevealed = \text{sum}(numSubSubRED, numSubSubGREEN, numSubSubBLUE)$$

$$numSubSubTotalCover = (totalSubSub * 3) - totalRevealed$$

$$numSubSubTotalBlackCover = \text{round}\left(\frac{numSubSubTotalCover * (255 - brightness)}{255}\right)$$

where brightness is the brightness computed in step 127.

Step 133, thus, computes the overall portion of each print-pixel 501 that should be fully opaque black to be used in computations described herein below.

The number of revealed sub-sub-pixels for each color and also the number of sub-sub-pixels for black cover are both victim of quantization error during the computations. For the herein-described case of twelve sub-sub-pixels per sub-pixel, this quantization error does not have an easily perceptible effect on the image for a human viewer, and the quantization errors can be ignored. If a print-pixel is designed with fewer sub-sub-pixels per sub-pixel, then these quantization errors become more noticeable in the produced image quality. The human eye is much more sensitive to brightness errors than color errors, so the priority is to repair the brightness quantization errors. The adjustability of the transparent-to-black photosensitive layer 105 allows an opportunity for correction.

Consider a print-pixel with 5 sub-sub-pixels for each of the three colors (red, green, blue), and a fourth (and much smaller) white sub-pixel made up of a single white sub-sub-pixel (WSSP). Such a print-pixel is a square print-pixel with 4×4 sub-sub-pixels total. Varying the black cover over this single white sub-sub-pixel, provides a mechanism for compensating for the brightness quantization error. This compensation may be performed by, at the beginning of the algorithm, assuming that single white sub-sub-pixel to be black (even if desired pixel overall color is pure white). Then when a brightness quantization error occurs, that white sub-sub-pixel WSSP can be darkened to the desired grayscale level to overcome the quantization error (if more brightness is desired, an additional black-covered sub-sub-pixel is allocated instead to white cover, then the difference made by darkening that single white sub-sub-pixel WSSP). The following is a sample code for an ordering list for the print pixel configuration having 5 colored sub-sub-pixel and one white sub-sub-pixel per sub-pixel:

```
// Simply an enumeration of names for the sub-sub-
    pixels
        private enum segNdx : int {
            grn1, grn2, blu1, blu2,
            grn3, grn4, blu3, blu4,
            grn5, red1, wht1, blu5,
            red3, red4, red5, red2 };
// The colors for the sub-sub-pixels (underneath the
    photosensitive layers)
```

-continued

```
        private static Color[ ] sub-pixelColors =
        {
            Colors.grnPx,   Colors.grnPx,   Colors.bluPx,
    Colors.bluPx,
            Colors.grnPx,   Colors.grnPx,   Colors.bluPx,
    Colors.bluPx,
            Colors.grnPx,   Colors.redPx,   Colors.whtPx,
    Colors.bluPx,
            Colors.redPx,   Colors.redPx,   Colors.redPx,
    Colors.redPx
        };
// This is the default ordering when there is no
    brightness preference direction.
        static int[ ] brightOrderNdxs =  {
            (int)segNdx.wht1,   (int)segNdx.red1,
    (int)segNdx.blu3,   (int)segNdx.grn4,
            (int)segNdx.grn5,   (int)segNdx.grn3,
    (int)segNdx.red3,   (int)segNdx.red4,
            (int)segNdx.grn1,   (int)segNdx.red5,
    (int)segNdx.red2,   (int)segNdx.blu2,
            (int)segNdx.blu4,   (int)segNdx.blu1,
    (int)segNdx.grn2,   (int)segNdx.blu5,
        };
// These are the orderings for the various
    brightness/darkness preference directions.
        static int[ ] darkTopppOrderNdxs =  {
            (int)segNdx.grn2,   (int)segNdx.blu1,
    (int)segNdx.grn1,   (int)segNdx.blu2,
            (int)segNdx.grn3,   (int)segNdx.blu4,
    (int)segNdx.grn4,   (int)segNdx.blu3,
            (int)segNdx.blu5,   (int)segNdx.grn5,
    (int)segNdx.wht1,   (int)segNdx.red1,
            (int)segNdx.red2,   (int)segNdx.red3,
    (int)segNdx.red5,   (int)segNdx.red4,
        };
        static int[ ] darkBottmOrderNdxs =  {
            (int)segNdx.red5,   (int)segNdx.red4,
    (int)segNdx.red2,   (int)segNdx.red3,
            (int)segNdx.blu5,   (int)segNdx.grn5,
    (int)segNdx.wht1,   (int)segNdx.red1,
            (int)segNdx.grn3,   (int)segNdx.blu4,
    (int)segNdx.grn4,   (int)segNdx.blu3,
            (int)segNdx.grn1,   (int)segNdx.blu2,
    (int)segNdx.grn2,   (int)segNdx.blu1,
        };
        static int[ ] darkLefttOrderNdxs =  {
            (int)segNdx.grn3,   (int)segNdx.grn5,
    (int)segNdx.grn1,   (int)segNdx.red3,
            (int)segNdx.grn2,   (int)segNdx.red4,
    (int)segNdx.grn4,   (int)segNdx.red1,
            (int)segNdx.blu1,   (int)segNdx.red5,
    (int)segNdx.blu3,   (int)segNdx.wht1,
            (int)segNdx.blu2,   (int)segNdx.red2,
    (int)segNdx.blu4,   (int)segNdx.blu5,
        };
        static int[ ] darkTopLfOrderNdxs =  {
            (int)segNdx.grn1,   (int)segNdx.grn2,
    (int)segNdx.grn3,   (int)segNdx.grn4,
            (int)segNdx.blu1,   (int)segNdx.grn5,
    (int)segNdx.blu2,   (int)segNdx.red3,
            (int)segNdx.blu3,   (int)segNdx.red1,
    (int)segNdx.blu4,   (int)segNdx.red4,
            (int)segNdx.wht1,   (int)segNdx.blu5,
    (int)segNdx.red5,   (int)segNdx.red2,
        };
        static int[ ] darkTopRtOrderNdxs =  {
            (int)segNdx.blu2,   (int)segNdx.blu4,
    (int)segNdx.blu1,   (int)segNdx.blu3,
            (int)segNdx.blu5,   (int)segNdx.grn2,
    (int)segNdx.red2,   (int)segNdx.grn1,
            (int)segNdx.wht1,   (int)segNdx.grn4,
    (int)segNdx.red5,   (int)segNdx.grn3,
            (int)segNdx.red1,   (int)segNdx.red4,
    (int)segNdx.grn5,   (int)segNdx.red3,
        };
        static int[ ] darkBotLfOrderNdxs =  {
            (int)segNdx.red3,   (int)segNdx.grn5,
    (int)segNdx.red4,   (int)segNdx.red1,
            (int)segNdx.grn3,   (int)segNdx.red5,
    (int)segNdx.grn1,   (int)segNdx.red2,
```

-continued

```
        (int)segNdx.grn4,   (int)segNdx.wht1,
(int)segNdx.grn2,   (int)segNdx.blu5,
        (int)segNdx.blu3,   (int)segNdx.blu1,
(int)segNdx.blu4,   (int)segNdx.blu2,
    };
    static int[ ] darkBotRtOrderNdxs =  {
        (int)segNdx.red2,   (int)segNdx.red5,
(int)segNdx.blu5,   (int)segNdx.wht1,
        (int)segNdx.red4,   (int)segNdx.blu4,
(int)segNdx.red3,   (int)segNdx.blu2,
        (int)segNdx.red1,   (int)segNdx.blu3,
(int)segNdx.grn5,   (int)segNdx.blu1,
        (int)segNdx.grn4,   (int)segNdx.grn3,
(int)segNdx.grn2,   (int)segNdx.grn1,
    };
```

At this point, knowing how many of each sub-sub-pixels 505 to reveal for each sub-pixel 503, and how many sub-sub-pixels to render black, the number of white sub-pixels is the remainder:

totalWhiteCover=(3*totalSubSub)−totalBlackCover−totalRevealed

Next the sub-sub-pixels that are to be opaque (white or black) are mapped on the grid of sub-sub-pixels 505 that make up the print-pixel 501, step 135. A preference is given to have opacity located on the periphery of the print-pixel 501. This result is achieved by ordering the sub-sub-pixels as to their relative order of priority for being made an opaque sub-sub-pixel. The opaque sub-sub-pixels are located according to that priority ordering until all opaque sub-sub-pixels have been assigned particular locations. If assigning opacity to a particular sub-sub-pixel would render the sub-pixel to which that sub-sub-pixel belong as having too few revealed sub-pixels from the print-pixel grid layer 111, the opacity is assigned to the next sub-sub-pixel in the opacity preference order.

At this point the opacity map 123 has been computed.

Next, the black cover map is computed. That calculation commences with determining the brightness positioning preference, step 137. To achieve sharp representation of brightness boundaries, the source image 121 is analyzed to identify sharp brightness boundaries and to set up a brightness positioning preference for each print-pixel 501; for print-pixels that do not lie on a brightness boundary, no brightness positioning preference is assigned.

For each pixel in the source image 121 direction and magnitude of the greatest brightness contrast is identified by comparing adjacent pixels while ignoring the brightness of the pixel for which a brightness positioning preference is being determined.

Thus, brightness contrasts are determined for the pairs above-below, left-right, aboveLeft-belowRight, aboveRight-belowLeft. As an example, the brightness contrast for the above-below pair is:

brightnessContrast(above,below)=abs(brightness(above)−brightness(below))

If the greatest brightnessContrast for any of these adjacent-pixel pairs is below a pre-defined threshold, e.g., 96/255, the brightnessPositioningPreference is set to none. If the greatest brightnessContrast is above or equal to the threshold, the dark side of the pair with the greatest brightnessContrast is remembered as the brightnessPositioningPreference for the pixel.

Next a darkness ordering preference is computed, Step 139. To determine the preference ordering for placement of black sub-sub-pixels, the sub-sub-pixels 505 that make up the print-pixel 501 are ordered according to their relative nearness to the brightnessPositioningPreference for that pixel. If the brightnessPositioningPreference is none, the sub-sub-pixels 505 located over bright sub-pixels 503 are given preference, i.e., green before red before blue, and secondary preference to sub-sub-pixels located on edges of the print-pixel 501 to reduce sensitivity for printing misalignments. Thus is produced the darkness ordered list of sub-sub-pixels.

Next the opaque black sub-pixels are allocated to the sub-sub-pixels that make up the print-pixel, step 141. Each black opaque sub-sub-pixel is allocated to a sub-sub-pixel in the order provided by the darkness ordered list of sub-sub-pixels. If as a black opaque pixel is to be allocated has not been marked to be opaque in the opacity map 123, that sub-sub-pixel is not marked as black and the next sub-sub-pixel in the darkness ordered list of sub-sub-pixels is considered. If the sub-sub-pixel has been marked to be opaque in the opacity map 123, it is marked to be black.

At the conclusion of this, the process 110 has determined the location of white sub-sub-pixels for the opaque-to-transparent layer 103 and black sub-sub-pixels revealed from the transparent-to-opaque layer 105. Next these maps are translated in to exposure patterns for each of the photon sensitive layers 103 and 105, step 143, resulting in an exposure mask for white 125*a* corresponding to the opaque-white-to-transparent layer, and an exposure mask for black 125*b* corresponding to the transparent-to-black layer.

Figure 11:
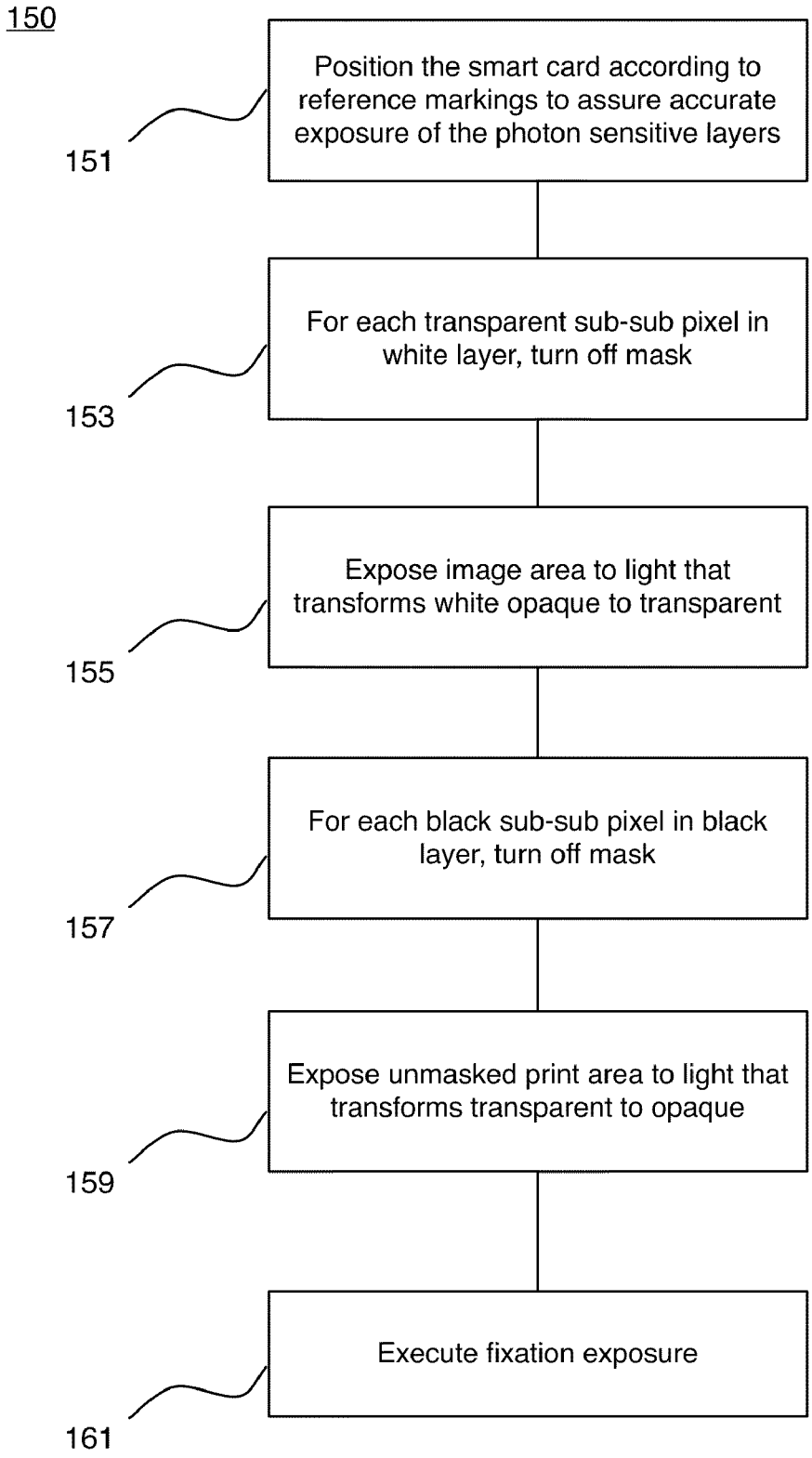
FIG. 11 is a flow-chart illustrating a process of using the masks produced from the process from FIG. 10 to create an actual image on an identity card.

FIG. 11 is a flow-chart illustrating a process 150 of using the masks produced from the process 110 to create an actual image on an identity card 100. First, the identity card 100 and the exposure equipment are aligned to assure accurate exposure of the photon sensitive layers 103 and 105 to produce the image, step 151. Misalignment could result in revealing the incorrect sub-sub-pixels from the print-pixel array 111. Thus, accurate alignment is very important.

Next, the white layer mask 125*a* is used to turn-off masking of sub-sub-pixels in the opaque-to-transparent layer 103 that are to be converted from opaque white to transparent, step 153.

The image area is then exposed to photons in the correct wavelength and intensity to convert from opaque to transparent, step 155.

Next, the transparent-to-opaque layer 105 is converted from transparent to black by first unmasking the sub-sub-pixels that are to be converted to black, step 157.

The unmasked sub-sub-pixels are next exposed to the requisite photons to cause the conversion from transparent to black, step 159.

Finally, the image is fixed through a fixation step 161. The method by which the image is fixed, i.e., the method by which the opaque-to-transparent layer 103 and transparent-to-opaque layer 105 are prevented from changing to other states, varies by material. The most straightforward case is for the opaque-to-transparent layer 103 being bleachable ink. Certain bleachable inks have been found to evaporate when exposed to UV laser. Thus, when the opaque-to-transparent layer 103 is transformed from opaque to transparent by removal of the pigmentation from that layer, it is not possible to revert back to being opaque. It is a one-way transformation.

If the opaque-to-transparent layer 103 is a spiropyran layer, the layer may be made fixable by including a fixing material in the layer, e.g., Ludopal as a photoreticulable polymer with benzoyl peroxide as radical initiator. This layer 103 may be fixed through exposure to UV light in the range of 488 nm to 564 nm with a power of approximately 3.5 milliwatts/cm$^2$ for approximately 5 seconds. Suitable equipment includes a black ray lamp B-100 A, No 6283K-10, 150 W from Thomas Scientific of Swedesboro, N.J., U.S.A. As an alternative a spiropyran opaque-to-transparent layer 103 may be fixed using heated rolls, e.g., 3M Dry Silver Developer Heated Rolls at 125 degrees Celsius on medium speed.

Figure 12:
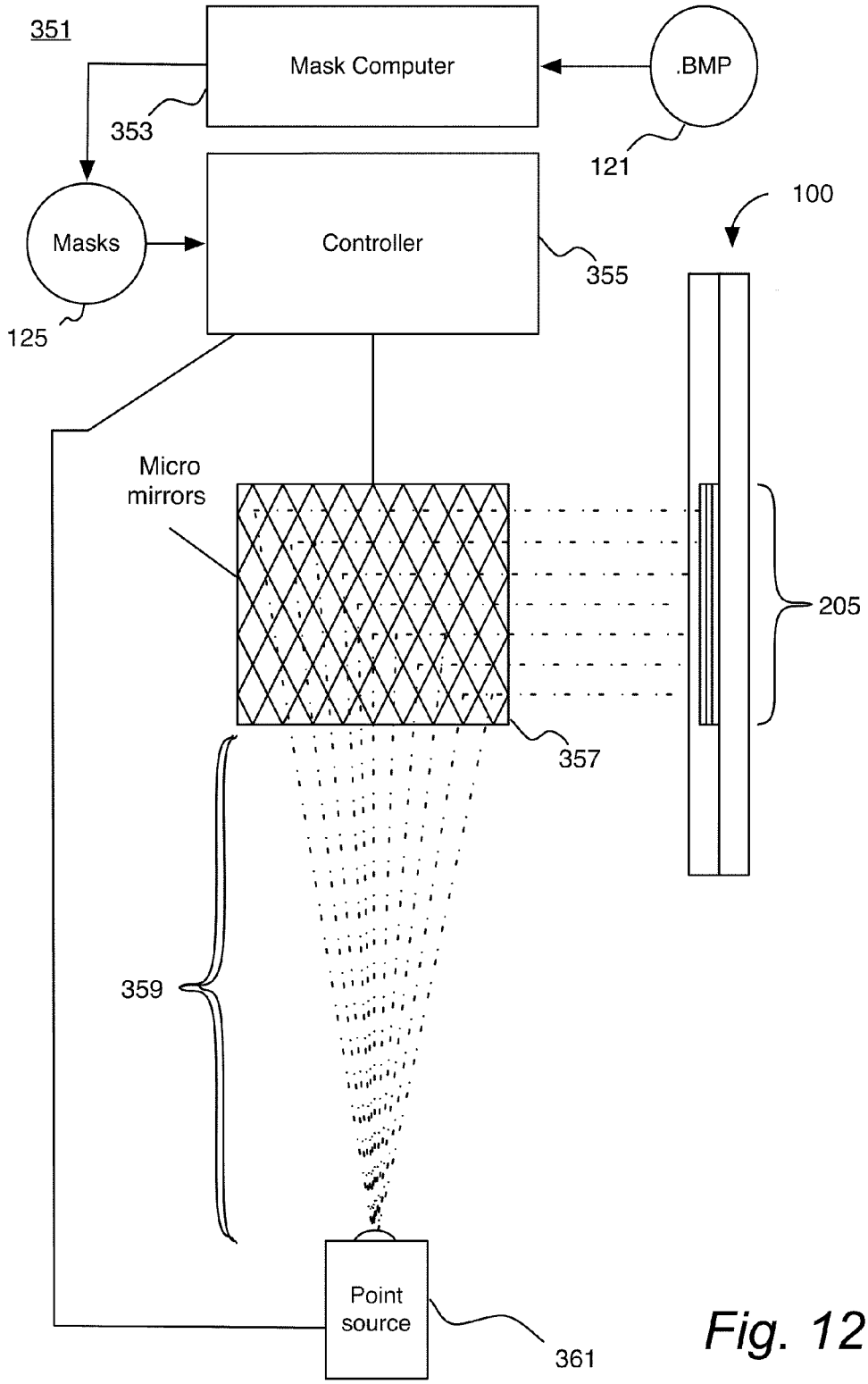
FIG. 12 is a first embodiment of personalization equipment that may be used to produce an image on an identity card.

Turning now to equipment that may be used for producing an image 203 in an image area 205 of an identity card 100. FIG. 12 is a block diagram of a first embodiment of a personalization station 351 for producing an image 203 in the manner described herein above. A .BMP digital image 121 is input into a mask computer 353. The mask computer 353 may be a general-purpose computer programmed to perform the computations of process 110 described herein above in conjunction with FIG. 10. The mask computer 353 thus includes a storage medium for storing instructions executable by a processor of the mask computer 353. When the processor loads these instructions, which include instructions to perform the operations of process 110, into its internal memory and executes the instructions with respect to the input .BMP image 121, the mask computer 353 produces the masks 125.

The masks 125 are input into a process controller 355. The process controller 355 is programmed to perform the steps of process 150 of FIG. 11. Thus the process controller 355 may use the masks to control an array of micromirrors 357 such that when a photon beam 359 emitted from a photon point source 361 is directed upon the micromirrors 357 the latter redirects the photon beam solely onto those sub-sub-pixels of the image area 205 that are to be exposed according to the masks 125. The controller 355 may also be programmed to control the photon source 361 to cause appropriate duration exposure of these sub-sub-pixels. In an alternative embodiment uses an array for micro-fresnel lenses in lieu of the micromirrors 357. In such an embodiment, each fresnel lens provides a focus onto a specific sub-sub-pixel.

Figure 13:
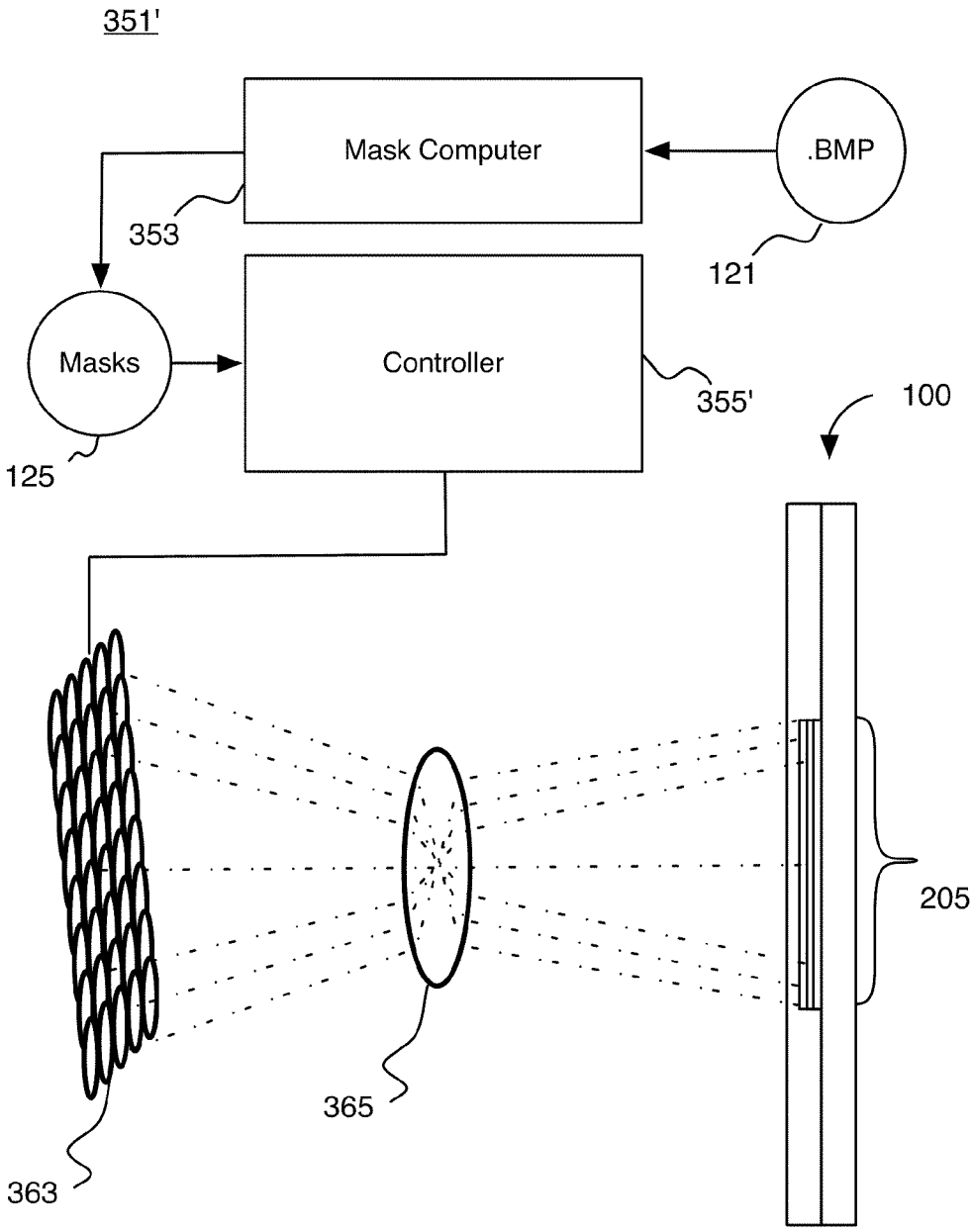
FIG. 13 is a second embodiment of personalization equipment that may be used to produce an image on an identity card.

FIG. 13 is an alternative embodiment of a personalization station 351' for producing an image 203 in an image area 205 of an identity card 100. In the case of the personalization station 351', a controller 355' is programmed to accept the masks 125 to control a light array 363 that is composed of a plurality of light sources. The light array 363 produces photons in the appropriate wavelength and intensity to convert the photon-sensitive layers of corresponding locations in the image area 205. In an embodiment, the photon beams produced by the light array 363 are focused through one or more lenses 365 to cause the trajectory of the photon beams onto the appropriate sub-sub-pixel locations in the image area 205.

Figure 14:
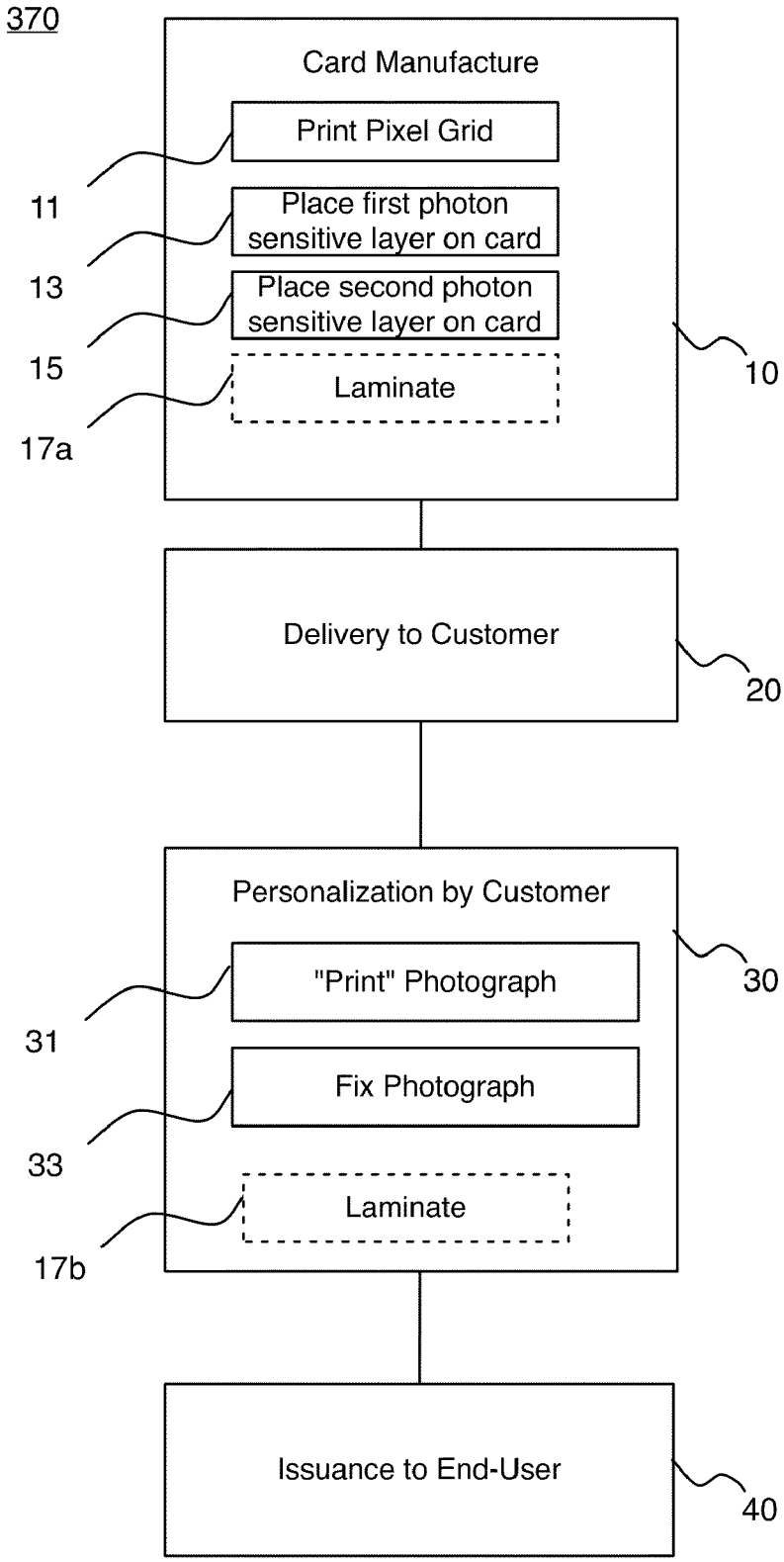

FIG. 14 is a flow-chart of a smart card life cycle 370 extended to include the technology described herein. In the card-manufacturing step 10, the print-pixel grid 111 is printed onto a substrate 107 of each card, step 11. This may be, for example, be performed through standard off set printing. Next the transparent-to-opaque layer 105 layer is deposited onto the card, step 13. Next the opaque-to-transparent layer 103 is placed on the card, step 15. And finally the card is laminated, step 17*a*. It should be noted that in some embodiments of the identity card 100, the lamination step is performed after the image 203 has been produced on the card 100.

The resulting manufactured card 100 has an image area 205 that consists of the print-pixel layer 111, the transparent-to-opaque layer 105, and the opaque-to-transparent layer 103 all optionally under a laminate layer 109. The cards 100 may now be delivered to customers, step 20.

It should be noted that for the embodiment of an identity card 100" illustrated in FIG. 3(*c*) the ordering of the above steps may be somewhat rearranged.

At the customers' locations, the cards 100 may be personalized for end-users, step 30. This includes rendering an image of the end-user onto the card, step 31, in the manner described herein above by converting an image file into masks 125 that may be used to control equipment that expose select locations of the image area to photons that selectively reveal or conceal sub-sub-pixels of various specified colors. After the image has been created, it is fixed, step 33. Alternatively, the cards 100 may be protected against alteration by adding a filter that filters out photons that would alter the photon-sensitive layers, e.g., by applying a filtering varnish to the card. In yet another alternative, an additional transparent layer is included between the upper lamination layer 109*a* and the photon-sensitive layers 103 and 105. This additional layer is also a photon sensitive layer. This additional layer, upon being exposed to photon energy or heat, transforms from being transparent to the wavelengths that transform the opaque-to-transparent layer 103 and transparent-to-opaque layer 105 to being opaque to those wavelengths thereby blocking any attempts to alter the image 203.

As described herein above, in some embodiments the change from opaque to transparent relies on evaporating away ink from the opaque-to-transparent layer 103. Therefore, the perso phase 30 may conclude with a lamination layer 17*b* after the personalization of the image area 205. The post-person lamination step 17*b* also provides an alternative opportunity for laying down a filter that blocks photons that could other wise further alter the image 203, in which case the fixation step 33 and the lamination step 17*b* may be considered to be one step.

Finally the card 100 may be issued to an end-user 40.

Thus, the smart card life cycle has been successfully modified to provide for post-issuance personalization by placing an end-user image on the card under a laminate thereby improving the personalization of the card while providing for a high degree of tamper resistance.

From the foregoing it will be apparent that a technology has been presented herein above that allows for personalization of sensitive articles such as identification cards, bank cards, smart cards, passports, value papers, etc. in a post-manufacturing environment. This technology may be used to place images onto such articles inside a lamination layer which may be applied before or after the lamination layer has been applied. Thus, the articles, for example, smart cards, may be manufactured in a mass produced fashion in a factory setting and personalized on relatively inexpensive and simple equipment at a customer location. The technology provides a mechanism for thus personalizing articles, such as smart cards, bank cards, identity cards, with an image that is tamper proof.

While the above description focuses on smart card personalization, which is a field in which the above described technology is ideally suited, the reliance on smart cards herein should only be considered as an example. The technology is also applicable to other devices and documents that benefit from secure personalization with an image. Some examples include identification cards, bank cards, smart cards, passports, value papers.

Although specific embodiments of the invention have been described and illustrated, the invention is not to be limited to the specific forms or arrangements of parts so described and illustrated. The invention is limited only by the claims.

The invention claimed is:

1. A method for producing an image in an image area on a physical media, comprising:

printing a print-pixel pattern on a substrate surface wherein the print-pixel pattern comprises a plurality of printpixels, each printpixel composed of a plurality of differently-colored sub-pixels;

covering the print-pixel pattern with a first photon-sensitive layer wherein the first photon-sensitive layer in a state of being transparent which is alterable at selected locations from being transparent to substantially opaque;

altering the state of the first photon-sensitive layer in a first selected pattern across the physical media thereby selectively occluding a selected subset of sub-pixels and portions of photon-sensitive layers corresponding to other sub-pixels thereby producing an image composed of the non-occluded sub-pixels and opaque photon-sensitive layer portions corresponding to other sub-pixels.

2. The method of claim 1 further comprising;

covering the print pixel pattern with a second photon-sensitive layer that is visually opaque and transforms into visually transparent upon exposure to photons of a second selected wavelength and intensity;

prior to altering the first selected portion of the first photon-sensitive layer, altering a second selected portion of the second photon-sensitive layer to reveal sub-pixels on the surface or any photon-sensitive layers between the print-pixel pattern located on the surface and the second photon-sensitive layer by exposing the second selected portion.

3. The method of claim 2 wherein the second photon-sensitive layer transforms from opaque white into visually transparent and the first photon-sensitive layer transforms from visually transparent into opaque black, and wherein the first photon-sensitive layer is positioned in between the second photon-sensitive layer and the print-pixel pattern located on the substrate surface.

4. The method of claim 3 comprising revealing a colored sub-pixel by exposing an area of the second photon-sensitive layer located above the colored sub-pixel to be revealed to photons of the second wavelength and intensity; and creating a black sub-pixel at a particular location by revealing an area of the first photon-sensitive layer corresponding to the particular location by exposing an area of the second photon-sensitive layer corresponding to the particular location to photons of the second wavelength and intensity and darkening the area of first photon-sensitive layer corresponding to the particular location by exposing the area of the first photon-sensitive layer also corresponding to the particular location to photons of the first wavelength and intensity.

5. The method of claim 3 wherein the second photon-sensitive layer is a white bleachable ink.

6. The method of claim 1 or 2 further comprising:

fixing the selected exposed portions of the photon-sensitive layers by an additional exposure step.

7. The method of claim 1 or 2 further comprising:

fixing the selected exposed portions of the photon-sensitive layer by exposing a portion of the image area of the physical media to UV light.

8. The method of claim 1 or 2 further comprising:

fixing the selected subset of sub-pixels of a photon-sensitive layer by exposing the selected subset of sub-pixels to heat.

9. The method of claim 1 or 2 wherein the alteration of a photon-sensitive layer is due to heat produced by photon exposure.

10. The method of claim 2 wherein the altering step comprises revealing sub-sub-pixels of individual sub-pixels thereby providing varying color intensities for different sub-pixels in the pixel pattern.

11. The method of claim 1 wherein each sub-pixel comprises a plurality of sub-sub-pixels, the step of altering the state of the photon-sensitive layers comprises:

occluding a subset of the sub-sub-pixels of any sub-pixel.

12. The method of claim 11 further comprising:

determining which sub-sub-pixels to occlude from a corresponding pixel in a digital image.

13. The method of claim 12 wherein the step of determining which sub-sub-pixels to occlude is based on the brightness of the corresponding pixel in the digital image and the hue of the pixel in the digital image.

14. The method of claim 12 wherein the step of determining which sub-sub-pixels to occlude is based on contrast transitions in the digital image.

15. A medium personalizable by selective exposure to photons, comprising:

a print-pixel pattern layer having a print-pixel pattern comprising a plurality of printpixels, each printpixel composed of a plurality of differently-colored sub-pixels;

a first photon-sensitive layer composed of a photon-sensitive material that transitions from transparent to substantially opaque upon exposure to photons of a first wavelength and intensity.

16. The medium personalizable by selective exposure to photons of claim 15, further comprising:

an opaque layer covering the pixel pattern and composed of a photon-sensitive material that transitions to being transparent upon being exposed to photons of a second wavelength and intensity.

17. The medium personalizable by selective exposure to photons of claim 15 where the first photon-sensitive layer is a laser-engravable carbon-doped polycarbonate layer.

18. The medium personalizable by selective exposure to photons of claim 16 where the opaque layer is a bleachable ink.

19. The medium personalizable by selective exposure to photons of claim 15 where the opaque layer is selectively removable by exposure to photons of particular wavelength and intensity.

20. The medium personalizable by selective exposure to photons of claim 15 wherein the print-pixel pattern is located on a surface of a substrate and between the surface of the substrate and a photon-sensitive layer.

21. The medium personalizable by selective exposure to photons of claim 15 wherein the print-pixel-pattern layer is photon-sensitive and wherein a photon-sensitive layer is located between the print-pixel-pattern layer and the substrate.

22. The medium personalizable by selective exposure to photons of claim 15 further comprising at least one lamination layer covering the at least one photon-sensitive layer and the print-pixel-pattern layer.

23. An apparatus for producing an image in an image area on a medium having a substrate with a surface printed with a print-pixel pattern and having a first photon-sensitive layer covering the print-pixel pattern wherein the first photon-sensitive layer is transparent and wherein the first photon-sensitive layer is alterable at selected locations from transparent to substantially opaque, the apparatus comprising:

a first photon source producing photons in a first wavelength;

at least one controllable photon distributor;

a controller connected to the first photon source and the photon distributor and programmed to selectively activate the first photon source and to control the controllable photon distributor to expose the first photon-sensitive layer in a selected pattern across the surface to photons in the first wavelength thereby selectively occluding a selected subset of sub-pixels of the pixel pattern and portions of photon-sensitive layers thereby producing an image composed of the non-occluded sub-pixels and occluded photon-sensitive layer portions.

24. The apparatus for producing an image of claim 23 wherein the controllable photon distributor is an array of micromirrors operable to selectively reflect photons emitted by the photon source onto the medium.

25. The apparatus for producing an image of claim 23 wherein the controllable photon distributor is a mask formed by an array of controllable elements that may be altered between an opaque state and a transparent state wherein each controllable element corresponds to a sub-pixel in the print-pixel pattern or a portion of a sub-pixel in the print-pixel pattern.

26. The apparatus for producing an image of claim 23 wherein the controllable photon distributor is a position-controllable laser operable to selectively expose areas of the medium corresponding to selected sub-pixels or portions of sub-pixels.

27. The apparatus for producing an image of claim 23 further comprising a heat source for exposing the medium to heat thereby fixing the state of each photon-sensitive layer.

28. The apparatus for producing an image of claim 23 further comprising a UV source for exposing the medium to UV light thereby fixing the state of each photon-sensitive layer.

29. The method of claim 2 wherein each sub-pixel comprises a plurality of sub-sub-pixels, the step of altering the state of the photon-sensitive layers comprises:

reveal a subset of the sub-sub-pixels of any sub-pixel.

30. The method of claim 29 further comprising:

determining which sub-sub-pixels to reveal from a corresponding pixel in a digital image.

31. The method of claim 30 wherein the step of determining which sub-sub-pixels to reveal is based on the brightness of the corresponding pixel in the digital image and the hue of the pixel in the digital image.

32. The method of claim 30 wherein the step of determining which sub-sub-pixels to reveal is based on contrast transitions in the digital image.

33. The apparatus of claim 23 wherein the medium further includes a second photon-sensitive layer wherein the second photon-sensitive layer is opaque and wherein the second photon-sensitive layer is alterable at selected locations from opaque to transparent, the apparatus further comprising:

a second photon source producing photons in a second wavelength;

the controller further connected to the second photon source and programmed to selectively activate the second photon source and to control the controllable photon distributor to expose the second photon-sensitive layer in a selected pattern across the surface to photons in the second wavelength thereby selectively revealing a selected subset of sub-pixels of the pixel pattern and a select subset of sub-pixels of the first photon-sensitive layer thereby producing an image composed of reveled sub-pixels, reveled portions of the occluded portions of the first photon-sensitive layer and occluded portions of the second photon-sensitive layer.

34. The apparatus of claim 33 wherein the apparatus is operable to expose the second photon-sensitive layer before exposing the first photon-sensitive layer thereby revealing select portions of the opaque-state first photon-sensitive layer and wherein the exposing of the first photon-sensitive layer produces areas of the image that are transparent to the surface, areas that are opaque in the first photon-sensitive layer and areas that are opaque in the second photon-sensitive layer.

* * * * *